US005138392A

United States Patent [19]

Kinoshita et al.

[11] Patent Number: 5,138,392

[45] Date of Patent: Aug. 11, 1992

[54] IMAGE FORMING APPARATUS WITH A FIXING DEVICE CAPABLE OF FIXING A TRANSPARENT MEMBER

[75] Inventors: Naoyoshi Kinoshita, Aichi; Keiji Kusumoto; Hiroyuki Ideyama, both of Toyokawa, all of Japan

[73] Assignee: Minolta Camera Kabushiki Kaisha, Osaka, Japan

[21] Appl. No.: 690,610

[22] Filed: Apr. 24, 1991

[30] Foreign Application Priority Data

Apr. 25, 1990 [JP] Japan ..... 2-109121
Apr. 25, 1990 [JP] Japan ..... 2-109123

[51] Int. Cl.[5] ..... G03G 15/20

[52] U.S. Cl. ..... 355/289; 219/10.57; 219/216; 355/282; 355/285

[58] Field of Search ..... 219/216, 10.57; 355/30, 355/202, 208, 282, 289, 290, 285, 286

[56] References Cited

U.S. PATENT DOCUMENTS 4,549,803 10/1985 Ohno et al. ..... 355/284
4,593,992 6/1986 Yoshinaga et al. ..... 355/282 X
5,041,718 8/1991 d'Hondt et al. ..... 355/208 X

FOREIGN PATENT DOCUMENTS 63-249174 10/1988 Japan .

*Primary Examiner*—A. T. Grimley
*Assistant Examiner*—P. J. Stanzione
*Attorney, Agent, or Firm*—Willian Brinks Olds Hofer Gilson & Lione

[57] ABSTRACT

An electrophotographic image forming apparatus for forming a color toner image by a developing device and fixing the toner image by a fixing device including top and bottom rollers. When OHP mode for forming images on transparency sheets is selected, the time required for fixing the toner image is prolonged so as to assure the transparency of the image fixed to a recording member. That is, if the size of the transparency sheet is larger than a predetermined value, the transparency sheet is sent to a returning path which returns the recording member discharged from the fixing device to the fixing device again, and if the size of the transparency sheet is smaller than the predetermined value, the fixing device is operated more slowly than a case of forming images on non-transparency sheets. Further, when the OHP mode is selected, heating power is supplied to both top and bottom fixing rollers, and when the OHP mode is not selected, the heating power is supplied to the top fixing roller only.

12 Claims, 18 Drawing Sheets

1
2
3
4
5
6
7
8
9
11
12
13
14
15
16
17
19
19a
20
21
22
23
24
25
26
27
28
30
31
32
33
34
35
35a
35b
36
36a
36CR
36ND
36MG
36YB
37
38
41
41a
42
43
44
45
46
47
48
49
50
51
52
53
54
55
56
57
58
59
60
61
62
70
71y
71m
71c
71k
72
72s
73
74
77
81
82
83
84
85
86
87
88
89
91
92
100
101
D
L
P
R1
R2
M1
M4
M5
M6
Y
M
C
BK

FIG. 8

| | upper roller 52 | | lower roller 53 |
|---|---|---|---|
| heater lamp / operation state | heater lamp 54 (700W) | heater lamp 55 (350W) | heater lamp 56 (350W) |
| during warm up | ○ | ○ | ○ |
| standby state | ○ | OFF | ○ |
| normal copy mode (light trans. not required) | ○ | OFF | OFF |
| OHP mode (light trans. required) | OFF | ○ | ○ |

IMAGE FORMING APPARATUS WITH A FIXING DEVICE CAPABLE OF FIXING A TRANSPARENT MEMBER

BACKGROUND OF THE INVENTION

1. Field of the Invention

The present invention relates to an image forming apparatus for reproducing original document images by an electrophotographic process using at least a single developing means for color development. More specifically, the present invention relates to an electrophotographic image forming apparatus capable of fixing a toner image by means of a fixing means having a set of rollers.

2. Description of the Related Art

Electrophotographic processes comprise a charging process to uniformly impart an electrical charge to the surface of a photosensitive member, an exposure process to partially discharge the electrical charge on the surface of the photosensitive member by irradiating said photosensitive member with light so as to form an electrostatic latent image thereon in accordance with the image information, a developing process for adhering toner contained in a developing material onto the aforesaid latent image so as to form a toner image, a transfer process for transferring the toner image to a recording paper sheet (hereinafter referred to as paper sheet), and a fixing process to fuse the transferred toner image to the paper by heating, and are widely used as a hardcopy image forming technique.

Copying machine using electrophotographic processes generally is capable of using transparency sheets such as those used by overhead projectors (OHP) in addition to plan paper sheets (non-transparencies).

When OHP copy images are formed containing red, blue or like colors, the light transmitting ability of the transparency must be assured by completely fusing the color toner to the surface of the transparency sheet in such a way that the surface of the sheet remains flat, thereby enhancing the reproducibility of the particular hue.

A typical method for assuring light transmitting ability of transparency sheets is to use in the fixing process a comparatively longer fixing time for the transparency than the time used for plain paper fixing. This method is safer than a method wherein the fixing means uses a heating temperature that is higher than normal.

When the OHP mode is selected by an operation key or the like, a conventional copying machine is constructed so as to be capable of executing the fixing process alone from among the previously mentioned electrophotographic processes on the supplied transparency. That is, the fixing process can be executed a plurality of times on a single transparent resin sheet.

When obtaining an OHP copy image from a conventional copying machine, the operator usually first selects the copy mode (the fixing time being identical to the fixing time for plain paper copying), and after fixing, the fixed transparency sheet is discharged with the color toner image corresponding to the original document image in a semi-fused state.

Then, after the operator selects the OHP mode, the previously discharged transparency sheet is manually fed into the copying machine and the color toner image is subjected a second fixing process wherein fusion of the aforesaid color toner image is completed to assure the light transmitting ability of the sheet.

Copying machines have been proposed which automatically select the OHP mode when a transparency sheet is detected, and the fixing time in the OHP mode is prolonged by retarding the rotational speed of the heating roller of the fixing means (U.S. Pat. No. 4,549,803).

The conventional copying machine capable of multiple executions of the fixing process in the manner described above requires that the operator must manually feed the temporarily discharged transparency sheet, thereby presenting a disadvantage in that the operator must perform an additional operational task.

Further, in the electrophotographic process, the transport speed of the entire surface of the transport sheet must be held uniform so as to prevent disruption (Deterioration of image quality) of the toner image caused by the flexibility of the sheet in the sheet transport direction.

Accordingly, when the fixing roller rotational speed is retarded, the rotational speed of the photosensitive member or transfer belt must be retarded in conjunction with the slowdown in the rotational speed of the fixing roller, or the distance between the transfer position and the fixing position must be longer than the length of the transfer sheet.

However, when the rotational speed of the transfer belt or the like is retarded, the exposure speed and developing speed must also be retarded in conjunction with the slowdown of the rotational speed of the transfer belt or the like. The operational speeds of all electrophotographic processes are dissimilar in the normal copy mode and the OHP mode. The operational controls therefore become more complex, and it is difficult to obtain optimal electrophotographic processing conditions (physical property values) suited to the respective operational speeds for normal mode and OHP mode, particularly immediately after mode switching, thereby resulting in a further disadvantage of a loss of stability in image quality.

When the distance between the transfer position and the fixing position is lengthened in accordance with the sheet size, the range of paper sizes that are be accommodated is broadened, for example, from B4 size sheets to A3 size sheets. Further disadvantage result therefrom inasmuch as the overall size of the copying machine becomes larger with a proportional increase in cost.

In addition, when the OHP mode is selected, the fixing process is executed at low speed even if the copy image is formed in black color toner only which does not require light transmitting ability. This arrangement results in still another disadvantage in that the time required for the copying process is unnecessarily prolonged.

The fixing means used to accomplish the fixing process in electrophotographic copying machines typically has top roller and a bottom roller that respectively make contact with the front surface (surface upon which the toner image is formed) and reverse surface of the copy sheet, and is constructed so as to apply heat of a specified temperature to these rollers by means of a heating lamp or similar heating means. The toner image formed on the front surface of the sheet passes between the aforesaid heated rollers and is fused thereon so as to be fixed to the surface of the copy sheet.

Regulation of the temperatures of the top and bottom fixing rollers, i.e., regulation of the fixing temperature, is controlled by detecting the surface temperature of each roller by means of temperature sensors, and supplying electrical power (ON) to the heating means when the surface temperature is less than a set temperature, and interrupting the supply of electrical power (OFF) to the heating means when the surface temperature exceeds a set temperature.

In conventional copying machines temperature regulation is typically executed for both the top fixing roller and bottom fixing roller whether in the normal copy mode or the OHP mode. That is, the heating means of each roller is individually controlled so as to switch ON/OFF according to the output from the respective temperature sensors. When the temperature of an individual roller becomes less than a set temperature, electrical power for heating is supplied to the individual roller concerned.

Therefore, a disadvantage arises inasmuch as the electrical power supplied to the fixing means is not used efficiently with regard to the overall power consumption of the copying machine.

In other words, when forming an OHP copy image incorporating color, the color toner on the transparency sheet must be completely fused thereon to retain the flatness of the sheet surface and assure the light transmitting ability so as to thereby enhance the reproducibility of the color as previously described. Accordingly, in the OHP mode, heating efficiency is most efficacious when applied from both the front and the rear of the toner image on the transparency sheet. More specifically, the direct heating application by the top roller on the toner image and the indirect heating application by the bottom roller through the transparency sheet and the temperature may be regulated for both the top roller and the bottom roller.

In contrast, direct heating of the toner image is sufficient in the normal copy mode because the copy image is not adversely affected even if the toner image is fixed in a semi-fused state. Further, the normal copy mode is frequently used to make multiple copies wherein the image of a single document repeatedly reproduced on a plurality of copy sheets, and using all the electrical power supplied to both rollers to regulate the temperature of the top roller is most efficient in assuring a specific fixing temperature even when making multicopies. Thus, conventional copying machines which supply electrical power to both fixing rollers when making multiple copies of a single document are inefficiently supplying said power.

In copying machines that use commercial power supplies (100V), the maximum power consumption is set at less than 1.5 kW so as to allow the use of normal indoor wiring (rated for current of 15 amps).

SUMMARY OF THE INVENTION

A main object of the present invention is to provide an image forming apparatus capable of producing copy image having light transmitting properties such as overhead projection images and the like and which provides operator ease of use.

Another object of the present invention is to provide an image forming apparatus that stabilizes image quality by allowing ready control of electrophotographic conditions.

A further object of the present invention is to provide an image forming apparatus that is capable of using a broad range of sizes of recording sheets without enlarging the size of the image forming apparatus.

A further object of the present invention is to provide an image forming apparatus capable of shortening as much as possible the time required to form copy images for overhead projection.

A still further object of the present invention is to provide an image forming apparatus capable of switching to a method that prolongs the fixing time in the fixing process for OHP transparencies in accordance with the relative size of the transparency sheet.

A even further object of the present invention is to provide an image forming apparatus capable of efficiently using the electrical power supplied to the fixing means.

A still further object of the present invention is to provide an image forming apparatus capable of changing the manner in which electrical power is supplied to the fixing device for the fixing process when plain paper is used as the recording sheet and when an OHP transparency is used as the recording sheet.

These and other objects of the present invention are accomplished by providing an image forming apparatus for forming original document images using an electrophotographic process, said image forming apparatus providing a developing means for forming color toner images corresponding to the original document images, a fixing means having a pair of rollers for fixing the aforesaid color toner image formed on a recording sheet, a transport means for transporting back to the fixing means a recording sheet previously discharged from the fixing means, a selection means for selecting the overhead projection mode to use an OHP transparency as the recording sheet, a document reading means to read an original document, a discrimination means for discriminating whether the original document image read by the document reading means includes only a black color image only or contains a color other than black, a detection means for detecting the size of the recording sheet, and a controlling means which, when the OHP mode is selected by the aforesaid selection means and the original document image is determined to contain a color other than black by the aforesaid discrimination means, controls the prolongation of the fixing time for the recording sheet by controlling the transport of the recording sheet by the transport means such that the recording sheet passes through the fixing means a plurality of times when the size of the recording sheet detected by the sheet size detecting means exceeds a specified value, and also controls the slowing of the rotational speed of the fixing rollers in the fixing means when the size of the recording sheet detected by the sheet size detection means is less than a specified value.

These and other objects of the present invention are accomplished by an image forming apparatus for copying original document images using an electrophotographic process, said image forming apparatus providing a fixing means for fixing the toner image formed on the surface of a recording sheet and having a first roller and a second roller that respectively confront the front surface and back surface of the recording sheet, a first heating means for heating the first fixing roller, a second heating means for heating the second fixing roller, a selection means for selecting either a first mode for normal image formation wherein plain paper is used as the recording sheet or a second mode for image formation wherein an OHP transparency is used as the recording sheet, and a control means for operating the aforesaid first heating means alone when the first mode is selected by the selection means and operating the second heating means alone when the second mode is selected.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIG. 8 is an illustration showing the conditions wherein electrical power is supplied to the fixing unit.

DETAILED DESCRIPTION OF THE PREFERRED EMBODIMENTS

The preferred embodiments of the present invention are described hereinafter with reference to the accompanying drawings.

Figure 1:
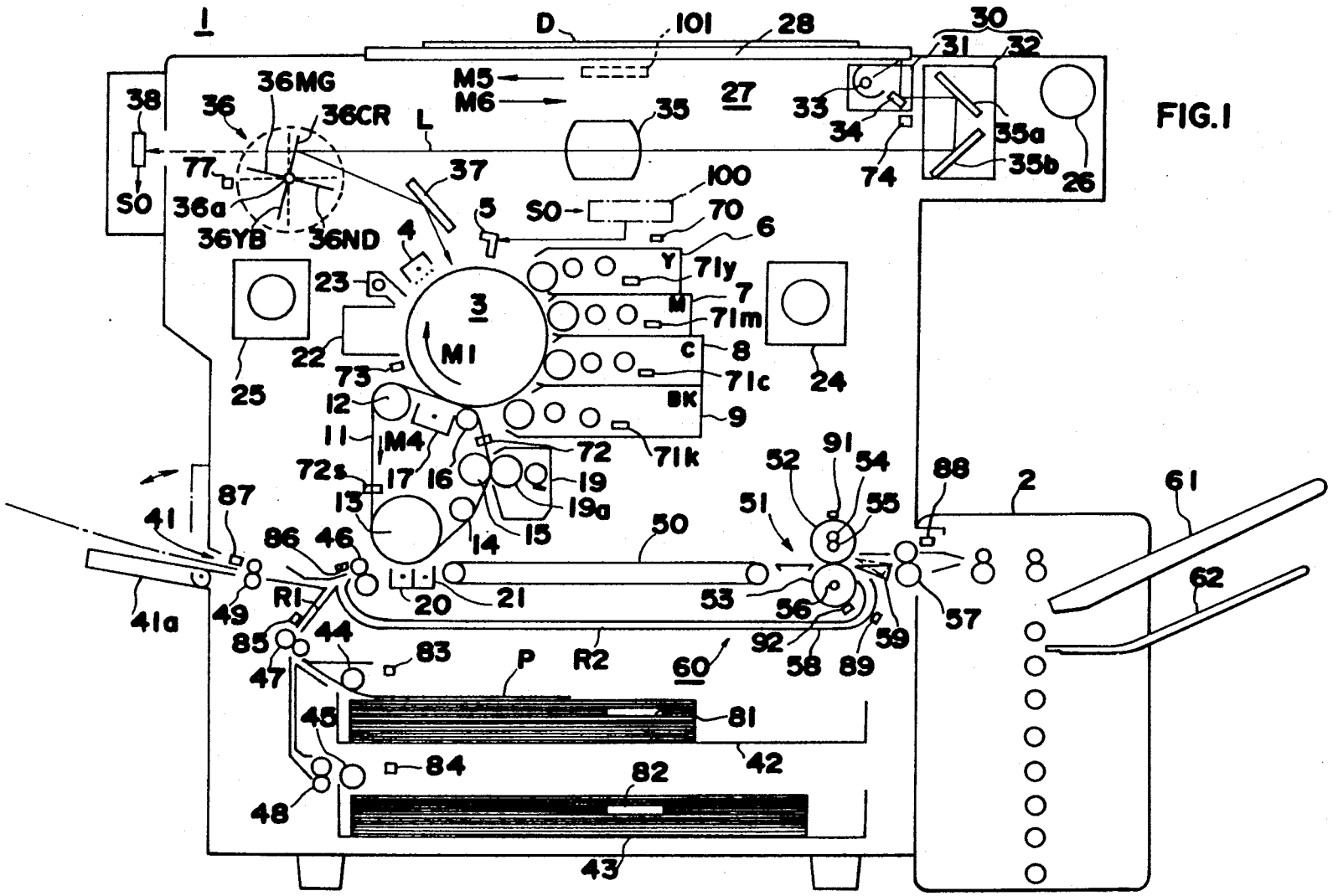
FIG. 1 is a front elevation view in section briefly showing an embodiment of the copying machine of the present invention.

FIG. 1 is a front elevation view in section briefly showing the construction of an embodiment of the present invention.

Slightly to the top left of center within copying machine 1 is provided a photosensitive drum 3 which is rotatable in the clockwise direction (arrow M1 direction). Around the periphery of the photosensitive drum 3 are arranged a charger 4, an editing eraser 5, developing devices 6 through 9, a transfer belt 11 as an intermediate transfer member, a cleaning unit 22, and a main eraser 23.

The surface of the photosensitive drum 3 has a photosensitive layer provided thereon. The surface of the photosensitive drum 3 is uniformly electrically charged by passing in proximity to the main eraser 23 and the charger 4, and is thereafter exposed to light from the optical unit 27 so as to form an electrostatic latent image thereon.

The editing eraser 5 comprises an LED (light-emitting diode) array of a plurality of LEDs arranged in a single row in a holder disposed along the axial direction of the photosensitive drum 3, and is constructed so as to be capable of partial erasure of the latent image formed on the surface of the photosensitive drum 3. The individual control of the ON and OFF timing of each LED is accomplished by an eraser controller disposed within the image processing portion 100 (refer to FIG. 3).

The developing devices 6, 7, 8 and 9 accommodate developing materials containing a mixture of triboelectrically charged carriers and respectively containing yellow (Y), magenta (M), cyan (C) and black (BK) color toners, respectively. The developing devices 6, 7, 8 and 9 are also provided toner density sensors (ATDC sensors) 71*y*, 71*m*, 71*c* and 71*k*, respectively, for detecting toner density. A humidity sensor 70 is provided above the developing device 6 to detect the humidity within the copying machine 1.

The developing devices 6 through 9 are not limited to a stationary arrangement on the circumference of the photosensitive drum 3, but also may be arranged, for example, in units that are movable in the vertical direction such that different color toners can be selectably supplied to the photosensitive drum 3.

The transfer belt 11 temporarily supports the toner image developed on the surface of the photosensitive drum 3 by the developing devices 6 through 9 so as to transfer (secondary transfer) said developed toner image to a sheet P. The transfer belt 11 is disposed around a plurality of rollers 12 through 16 and is supported so as to be rotatable in the counterclockwise direction (arrow M4 direction) in contact with the photosensitive drum 3.

Inside of the transfer belt 11 is provided a transfer charger 17 used for the primary transfer of the toner image developed on the surface of the photosensitive drum 3 onto the transfer belt 11. Outside the transfer belt 11 is provided a secondary transfer charger 20, a separation charger 21 for separating the sheet P from the transfer belt 11, and a belt cleaner 19 having a fur brush 19*a* for sweeping the exterior surface of the transfer belt 11. The fur brush 19*a* selectably makes contact with (during sweeping) and is removed from the transfer belt 11.

Belt mark sensors 72 and 72*s* are fixedly disposed between rollers 15 and 16 and rollers 12 and 13, respectively, to detect the rotational angle position of the transfer belt 11.

An original document glass platen 28 is provided on the top of the copying machine 1, and immediately below the interior surface of the document platen 28 is integrated a document size sensor 101 for detecting the size of the original document D and which travels so as to scan without hindrance.

An optical unit 27 is provided in the upper portion of the copying machine 1. The optical unit 27 comprises a scanner 30 that is reciprocally movable in the direction of arrow M5 (outgoing direction) below the document platen 28 and in the direction of arrow M6 (returning direction), a main lens for positional adjustment in accordance with the copy magnification, a filter selector 36 for color separation of the exposure light, a stationary mirror 37 that guides the scanning light L reflected by a mirror attached to the filter selector 36 to the photosensitive drum 3, and a color image sensor 38 that receives the scanning light L which is transmitted through the mirror of the filter selector 36; during the outgoing travel by scanner 30, the original document D is scanned and the photosensitive drum 3 is subjected to light exposure.

The scanner 30 comprises a first slider 31 having an exposure lamp 33 and a mirror 34, and a second slider 32 having mirrors 35*a* and 35*b*. During the scan of the original document D, the first slider 31 travels outwardly at a speed of v/n (where n is the copy magnification) relative to the circumferential speed of the photosensitive drum 3. The second slider 32 is operated by a scanning motor, not shown in the drawing, so as to travel outwardly at a speed of v/2n. When the outward travel of the scanner 30 is completed, the return of said scanner 30 toward the reference position (home position) is detected by a scanner home switch 74 that comprises a photosensor.

The filter selector 36 has an arrangement of a half mirror 36ND (transmission to reflection ratio 6:4), and three individual filter mirrors 36YB, 36MG and 36CR mounted radially at mutual 90° angles and centered on axis 36*a*. The aforesaid mirrors are selectively switchable by rotating the filter selector 36. The filter mirrors 36YB, 36MG and 36CR single integrated units comprising a mirror and a filter formed by vapor deposition of blue (B), green (G) and red (R) color separation filter on the respective mirrors. The aforesaid filters are used for Y, M and C color toners, respectively.

In the exposure scan for image formation, the reflecting surface of the selected mirror is positioned so as to be inclined about a 10° angle in the clockwise direction from the perpendicular, and the scanning light L is guided to the exposure point on the surface of the photosensitive drum 3 by the aforesaid selected mirror. In the preliminary scan for reading the image of the original document D prior to the exposure scan, the half mirror 36ND is selected and the mirror is positioned to intersect the entrance direction of the scanning light L so as to enhance the modulation transfer function MTF (image formation power) of the color image sensor 38. Item 77 is a rotation position sensor for determining the home position of filter selector 36. FIG. 1 shows the condition wherein filter mirror 36CR has been selected and positioned for use.

In the following description, half mirror 36ND, and filter mirrors 36YB, 36MG and 36CR are respectively the ND filter, B filter, G filter and R filter based on color separation characteristics.

The color image sensor 38 comprises three rows each containing a plurality of photoreceptors arrayed in the main scan direction. The first, second and third element rows are respectively provided a R filter, G filter and B filter. A single photoreceptor element corresponds to a single picture element of the original document image, and photoelectric conversion signals S0 corresponding to the intensity of the light reflected by each photoreceptor elements in correspondence with a single image element color are transmitted to the image processing portion 100 (refer to FIG. 3).

On the other hand, a top paper cassette 42 and a bottom paper cassette 43 for accommodating paper P are provided in the bottom portion of copying machine 1, and provided at the left side of the copying machine 1 is a manual feed paper port 41 that is opened by opening a door 41*a* to manually feed paper P. The paper cassettes 42 and 43 and manual feed port 41 can be used alternatively.

The paper cassettes 42 and 43 are respectively provided take up rollers 44 and 45 which discharge paper P accommodated therein sheet by sheet, paper size sensors 81 and 82 for detecting the size of paper P, and paper empty sensors 83 and 84 for detecting when said paper cassettes are out of paper. The manual feed port 41 is provided a manual feed sensor 87 for detecting when paper P has been inserted therein.

The paper P supplied from the paper cassette 42 is transported by feed roller 47 to timing roller 46, and the paper P supplied from the paper cassette 43 is transported by feed rollers 48 and 47 to timing roller 46 where said paper P is held temporarily. The paper P inserted into the manual feed port 41 is transported by manual feed roller 49 to timing roller 46.

A paper sensor 85 is provided near paper roller 47 to detect the presence of paper P in paper path R1 between the feed roller 47 and the timing roller 46. A timing sensor 86 is provided near the timing roller 46 to detect the leading edge position of the sheet P which is passing path R1.

During the standby interval, paper P is transported so as to align the timing with the transfer belt 11 via the rotation of the timing roller 46, then at the transfer position the toner image is secondarily transferred to the paper P from the transfer belt 11. Thereafter, paper P is transported to the fixing unit 51 by the transport belt 50 which has a linear distance corresponding to the size of an A4 sheet.

The fixing unit 51 comprises a top roller 52 having two heating lamps 54 and 55, and a bottom roller 53 having a single heating lamp 56. The fixing unit 51 fixes the toner image by fusing said toner image on paper P. The temperature sensors 91 and 92 comprising thermistors are provided near each of the rollers 52 and 53. In the copying machine 1 of the present embodiment, the power rating of the heating lamp 54 is 700W, and the power rating of the heating lamps 55 and 56 is 350W.

The paper P bearing the fixed toner image that forms the desired copy image is transported to sorter 2 by means of discharge rollers 57 arranged near discharge sensor 88. The paper P is discharged to either tray 61 or bin 62 accommodated in sorter 2.

A sheet returning device 60 is provided in copying machine 1 and is used for refixing during OHP mode copying described later. The sheet returning device 60 transports the paper P, which has already passed through the fixing unit 51, so as to return said paper P once again to the entrance (transport belt 50 side) of the fixing unit 51. The sheet return device 60 comprises a transport mechanism 58 having a return path R2 that passes from the discharge side of the fixing unit 51 through the previously described timing rollers 46, and a switching hook 59 for switching the transport direction of paper P discharged from the fixing unit 51 to either the discharge roller 57 or the return path R2. The switching hook 59 is actuated by a solenoid not shown in the drawing. The transport mechanism 58 comprises a guide plate and transport means such as a suitably disposed belt or roller. A returning paper sensor 89 is provided in transport mechanism 58 to detect the presence of paper P in the return path R2 near the switching hook 59.

The paper P can be subjected to the fixing process a plurality of times, not by manually refeeding the sheet as in conventional apparatus, by rather by means of the previously described return device 60.

In FIG. 1, item 24 is a main motor supplying the power for the operation of each component related to the supply and transport of paper P. Item 25 is a PC motor for supplying the power for the operation of the photosensitive drum 3, the transfer belt 11 and the like. Item 26 is a cooling fan.

In the copying machine 1 of the construction described above, simple one toner monocolor copy images in the previously mentioned colors of Y, M, C and BK can be formed, composite monocolor copy images in the colors of R (Y and M), G (Y and C) and B (M and C) can be formed by overlaying two color toner images from among the three colors Y, M and C, and color (full color) copy images can be formed by overlaying three color toner images.

In forming simple single color and composite monocolor copy images, the original document D is scanned by light using the half mirror 36ND, and the electrostatic latent image formed on the photosensitive drum 3 is developed by one developing device from among the developing devices 6 through 9 in accordance with the specified color, then the toner image is transferred onto the transfer belt 11. When a composite monocolor copy image is formed, the same original document D is again scanned by light using the half mirror 36ND, and the toner image developed by another of the developing device 6 through 9 is transferred onto the transfer belt 11 so as to produce two color toner images one superimposed on the other on the transfer belt 11.

When a color copy image is formed, the copying machine 1 sequentially uses four color toners by adding BK to Y, M and C so as to enhance the reproducibility of the black color portions. That is, the same original document D is subjected to a total of four scanning exposures, the filters B, G, R and ND as well as the developing devices 6 through 9 are selectively switched for each scan, the color separated electrostatic latent images of original document D are formed and developed, then the toner images are sequentially transferred onto the transfer belt 11 so that the toner images of each color are superimposed one over another onto the transfer belt 11.

When the toner images are superimposed one over another (hereinafter referred to as "multilayer transfer"), each toner image must be transferred to exactly the same position on the transfer belt 11. Therefore, in the present embodiment of copying machine 1 the timing for generating the belt mark signals S10 from the previously described belt mark sensors 72 and 72*s* is standardized to control the timing for starting the movement of the scanner 30, i.e., the timing for starting the formation of the electrostatic latent image on the photosensitive drum 3.

When forming color copy images, a preliminary scan is performed to discriminate the color image portion of the image of the original document D which contains color and the monochrome image portion which does not contain color. Thereafter, during image formation with the Y, M and C color toners, the latent image corresponding to the monochrome image portion is erased by the editing eraser 5 prior to developing, and conversely, during image formation with BK toner, the latent image corresponding to the color image portion is erased prior to developing. That is, the color image portion is reproduced by the multilayer transfer of each of the toners Y, M and C, while the monochrome image portion is reproduced by the BK toner only. Thus, sharp copy images without fine color irregularity can be obtained for image of small line width such as characters and lines which are typically expressed in black color, and natural looking copy images having superior color reproducibility can be obtained for multicolor images such as color photographs and the like.

Figure 2:
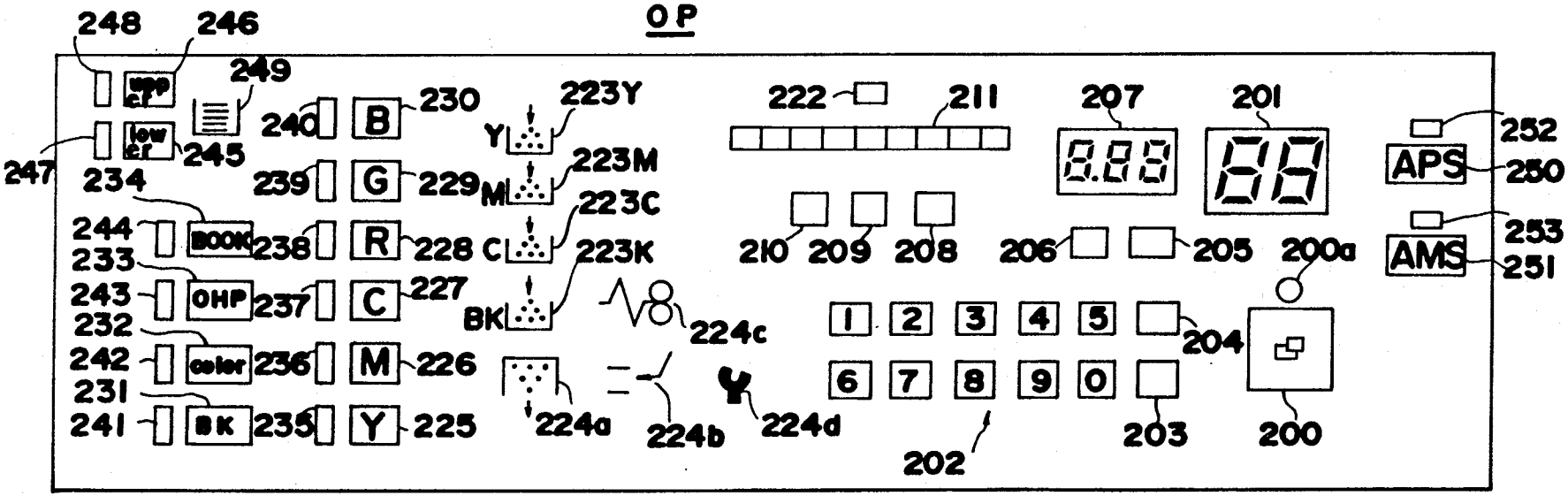
FIG. 2 is a plan view of the operation panel provided on the top of the copying machine.

FIG. 2 is a top plan view showing the operation panel OP provided at the top of copying machine 1.

On the right side of operation panel OP are provided a key 250 for setting the automatic sheet selection mode and its display LED 252, a key 251 for setting the automatic magnification selection mode and its display LED 253, a print key 200 for starting the copy operation, an LED 200*a* that is switched ON when the copy operation is enabled to start, a ten-key pad 202 for setting the copy conditions such as copy number and the like, a seven-segment LED 201 for displaying the copy number, a clear/stop key 203, an interrupt key 204, a magnification increment key 205 and a magnification decrement key 206 for setting the copy magnification, a three-column seven-segment LED 207 for displaying the copy magnification, an incrementing key 210 and decrementing key 208 for graduated manually setting of the copy image density, an LED 211 for displaying the copy image density level, an auto-density setting key 209, an auto-density display LED 222, and like keys and display LEDs used for the normal copy operations.

On the left side of the operation panel OP are provided LEDs 223Y, 223M, 223C and 223BK for respectively indicating an insufficiency of color toner Y, M, C and BK, an LED 224*a* for indicating that the waste toner receptacle is full, an interrupt display LED 224*b*, a paper jam display LED 224*c*, a trouble display LED 224*d*, color keys 225 through 231 corresponding to each color (Y, M, C, R, G, B, BK) for specifying the color of a monocolor copy image, a full color key 232 for specifying a full color copy, an OHP key 23 for selecting the OHP mode when using an OHP (overhead projector) transparency as the sheet P, a book key 234 that is used when copying an image on two facing pages in book-like format, LED displays 235 through 244 corresponding to each of the aforesaid keys 225 through 234, paper selection keys 245 and 246 for selecting paper cassettes 42 and 43 respectively, LEDs 247 and 248 for indicating the selected cassette 42 and 43 respectively, and paper empty LED 249 for indicating that the selected cassette 42 or 43 is empty of paper.

In the description that follows, color keys 225, 226, 227, 228, 229, 230 and 231 are referred to as the Y-key, M-key, C-key, R-key, G-key, B-key and BK-key, respectively.

Figure 3A:
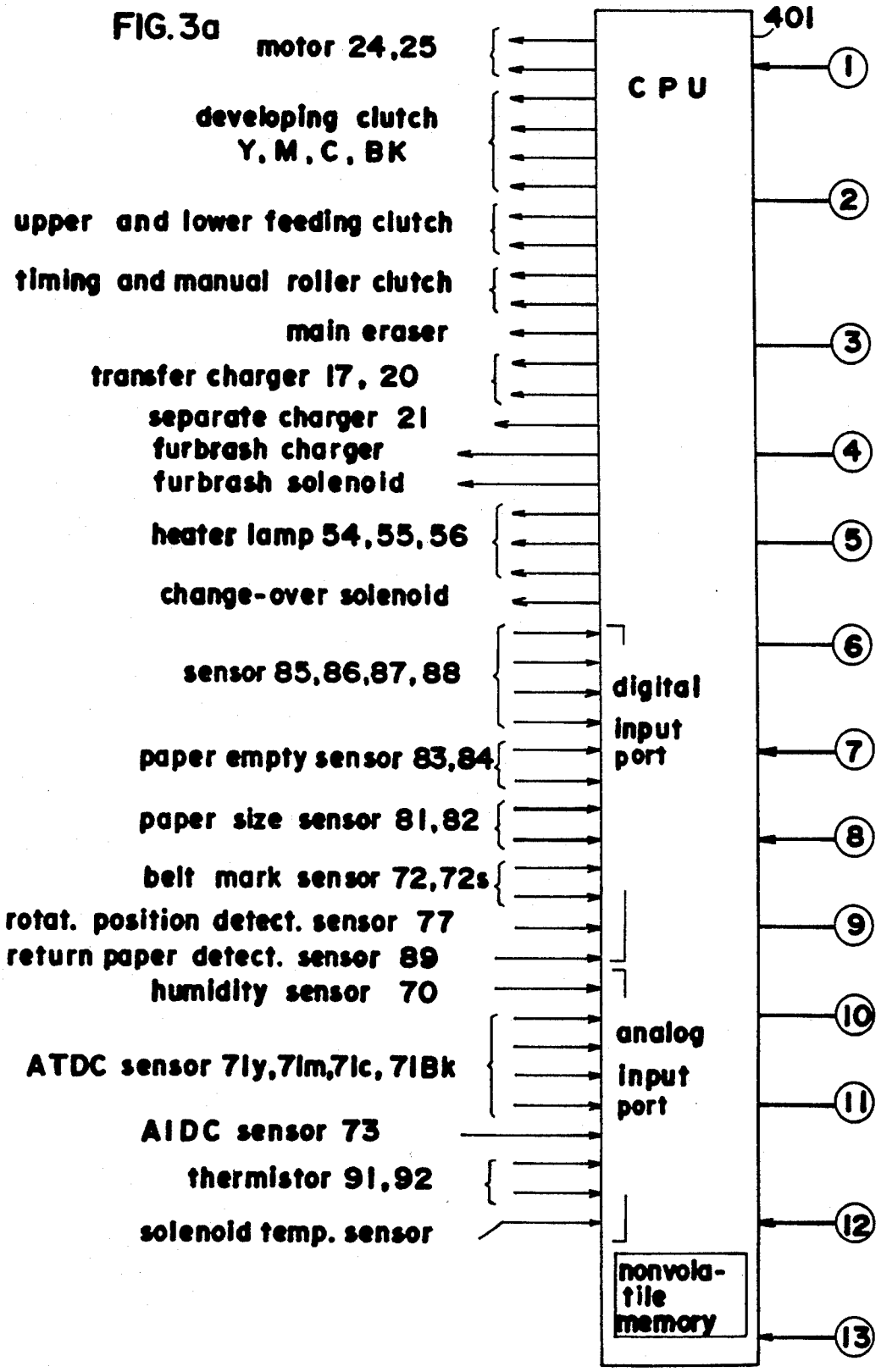
FIG. 3 is a block diagram showing the operation of the copying machine shown in FIG. 1.
Figure 3B:
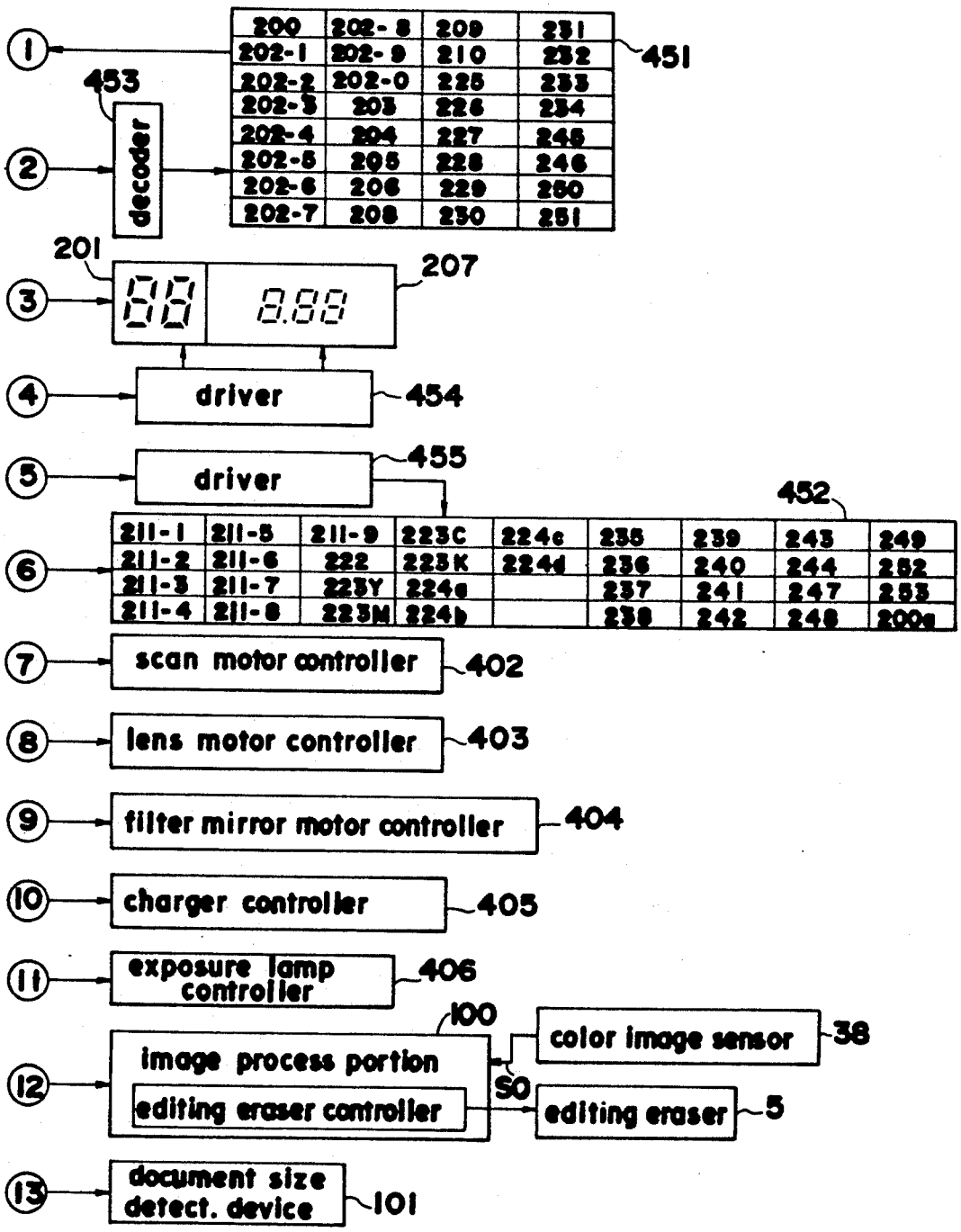

FIG. 3 is a block diagram of the control portion 400 of copying machine 1.

The control portion 400 is based on a CPU (central processing unit) 401 for controlling the entire operation of copying machine 1 , and comprises a scan motor controller 402 for controlling the operation of the scanner 30, a lens motor controller 403 for controlling the movement of the main lens 35 in accordance with the copy magnification, a filter mirror motor controller 404 for controlling the operation of the filter selection device 36, a charger controller 405 and an exposure lamp controller 406.

The CPU 401 is connected to a switch matrix 451 and display matrix 452 for each controller, each operation key and each display LED on operation panel OP, seven-segment LEDs 201 and 207, a decoder 453 for switch matrix 451, and drivers 454 and 455 for supplying electrical power to light each LED.

In addition, the CPU 401 is also connected to the image processing portion 100 for discriminating the color in each small region of the original document and controlling the editing eraser 5 based on the discrimination results, and a document size sensor 101 using a common detection technique to determine the size and placement direction (latitudinal or longitudinal) of the original document D by integrating the outputs from the plurality of reflective-type photosensors.

The output signals of the sensors provided in each section of the copying machine 1 are input to the analog input ports and digital input ports of the CPU 401, and the ON/OFF switching or operation level of each component such as the motors 24 and 25 connected to the output ports, all clutches such as the developing clutch and each charger are controlled based on the signals from each sensor and switch matrix and the data from the image processing portion 100 and the document size sensor 101.

The CPU 401 is provided an internal nonvolatile memory for storing processing data such as the cumulative copy number, jam generation frequency and the like.

The operation of the copying machine 1 is described hereinafter with reference to the flow charts.

Figure 4:
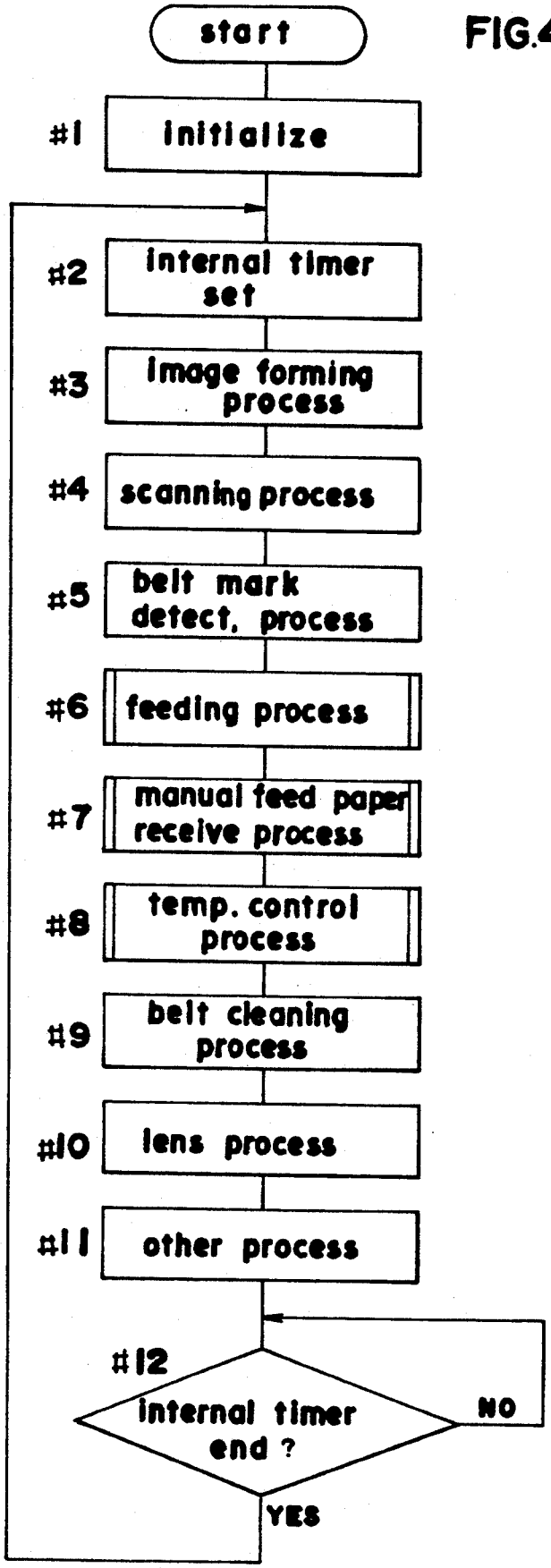
FIG. 4 is a flow chart showing the main routine for the operation of the copying machine shown in FIG. 1.

FIG. 4 is the main flow chart showing briefly the operation of the copying machine 1.

When power is switched ON and the program starts, the registers and peripheral interfaces are initialized (step 1), and the internal timer is set to set the length of a single routine for the CPU 401 (step 2).

In step 3, the image formation processing related to the electrophotographic process is executed, and in step 4 the scan process is executed for scanning the original document D.

In step 5, the belt mark detection process is executed for determining the timing of multilayer transfers, and in step 6 the paper feed process is executed to control the supplying and transporting of paper P. Thereafter, in step 7, the manual sheet feed process is executed for determining the timing for manually fed sheets inserted in manual feed port 41.

Subsequently, the copy sequence processes are consecutively executed: the temperature regulating process for adjusting the temperature of fixing unit 51 (step 8), the belt cleaning process for sweeping the transfer belt 11 (step 9), the lens process for controlling the movement of the main lens 35 in accordance with copy magnification (step 10), and input process for receiving signals from the operation keys on the operation panel OP as well as other processing (step 11).

After the aforesaid processes are executed, the internal timer is awaited in step 12, and when the timer is completed the routine returns to step 2. Thus, the length of one routine is standardized, and each process in steps 2 through 12 is repeated while electrical power remains applied.

Figure 5A:
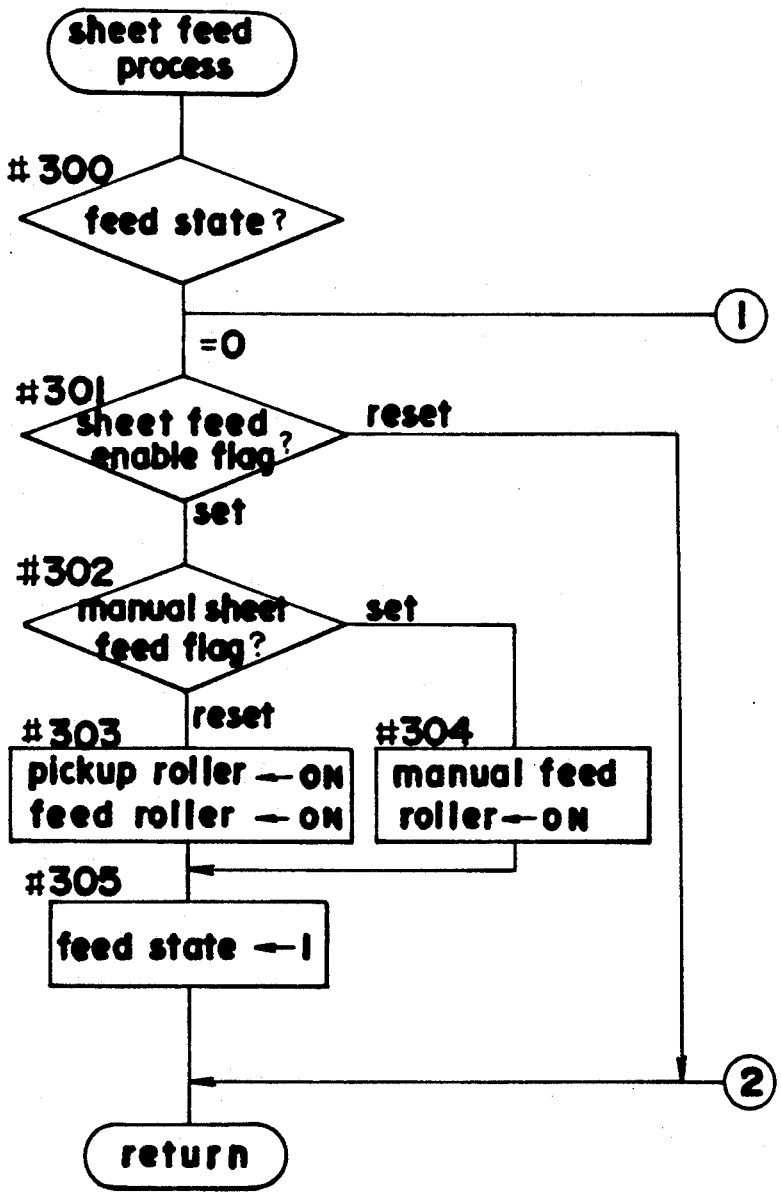
FIG. 5 is a flow chart showing the subroutine for executing step 6 of the main routine.
Figure 5B:
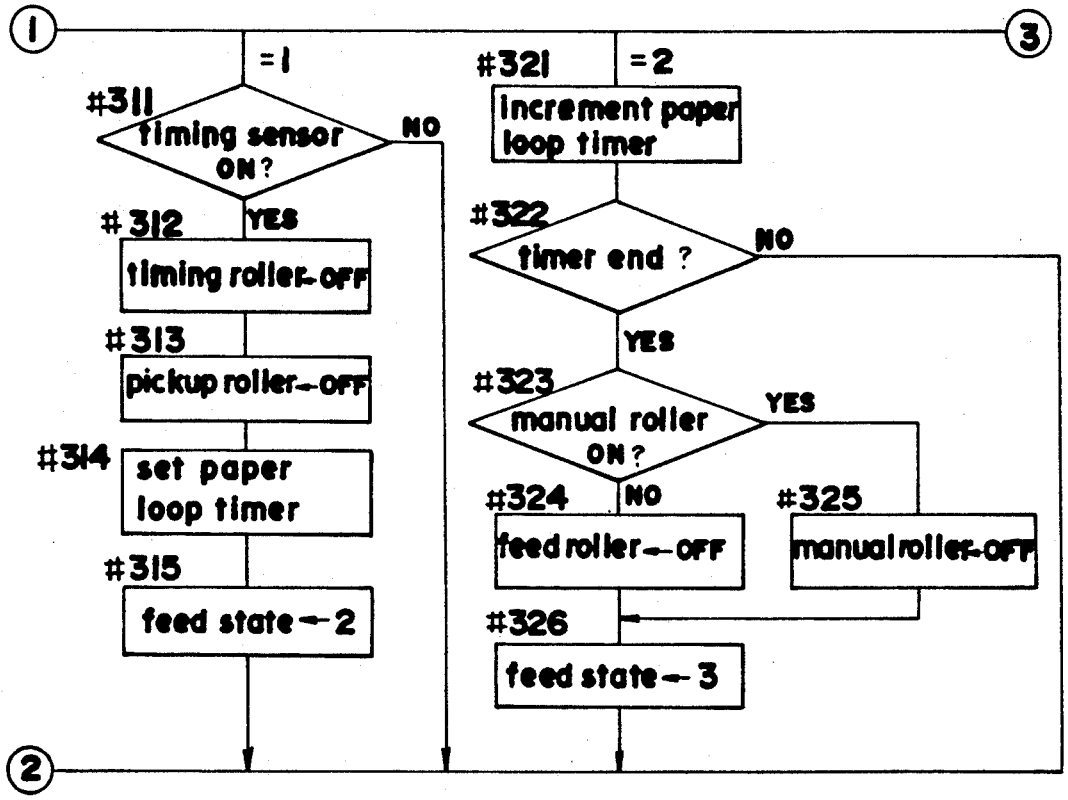
Figure 5C:
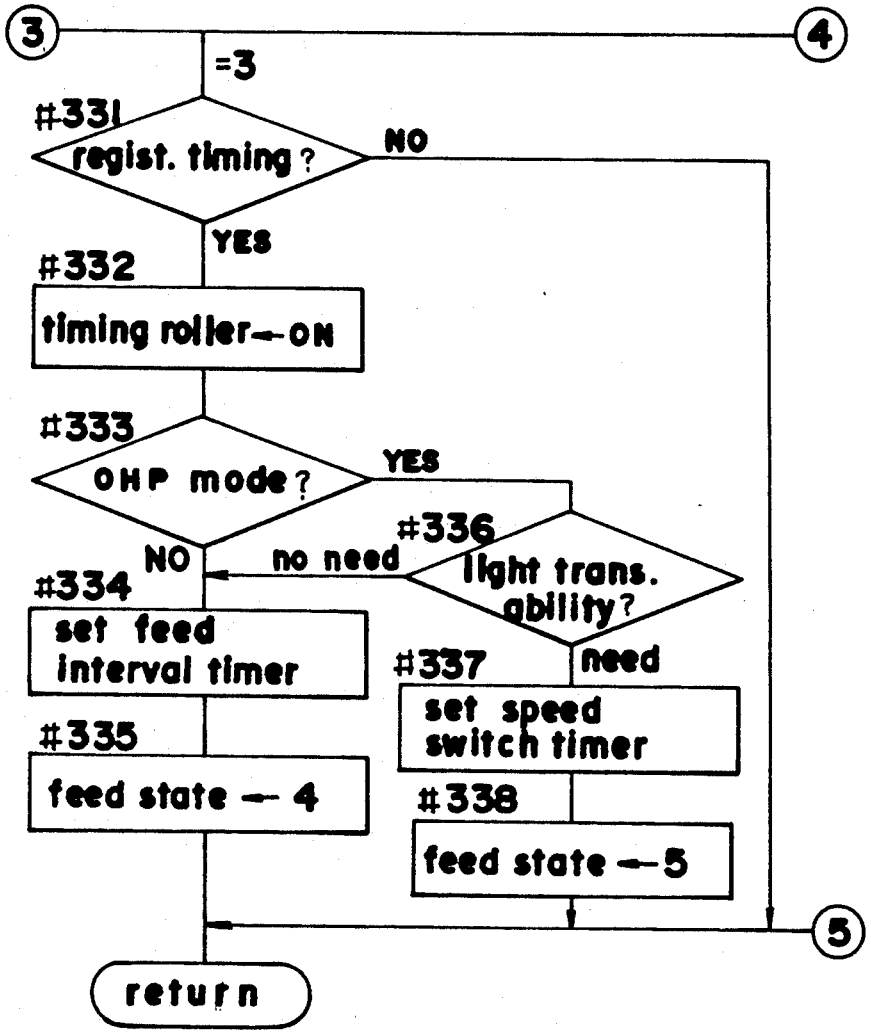
Figure 5D:
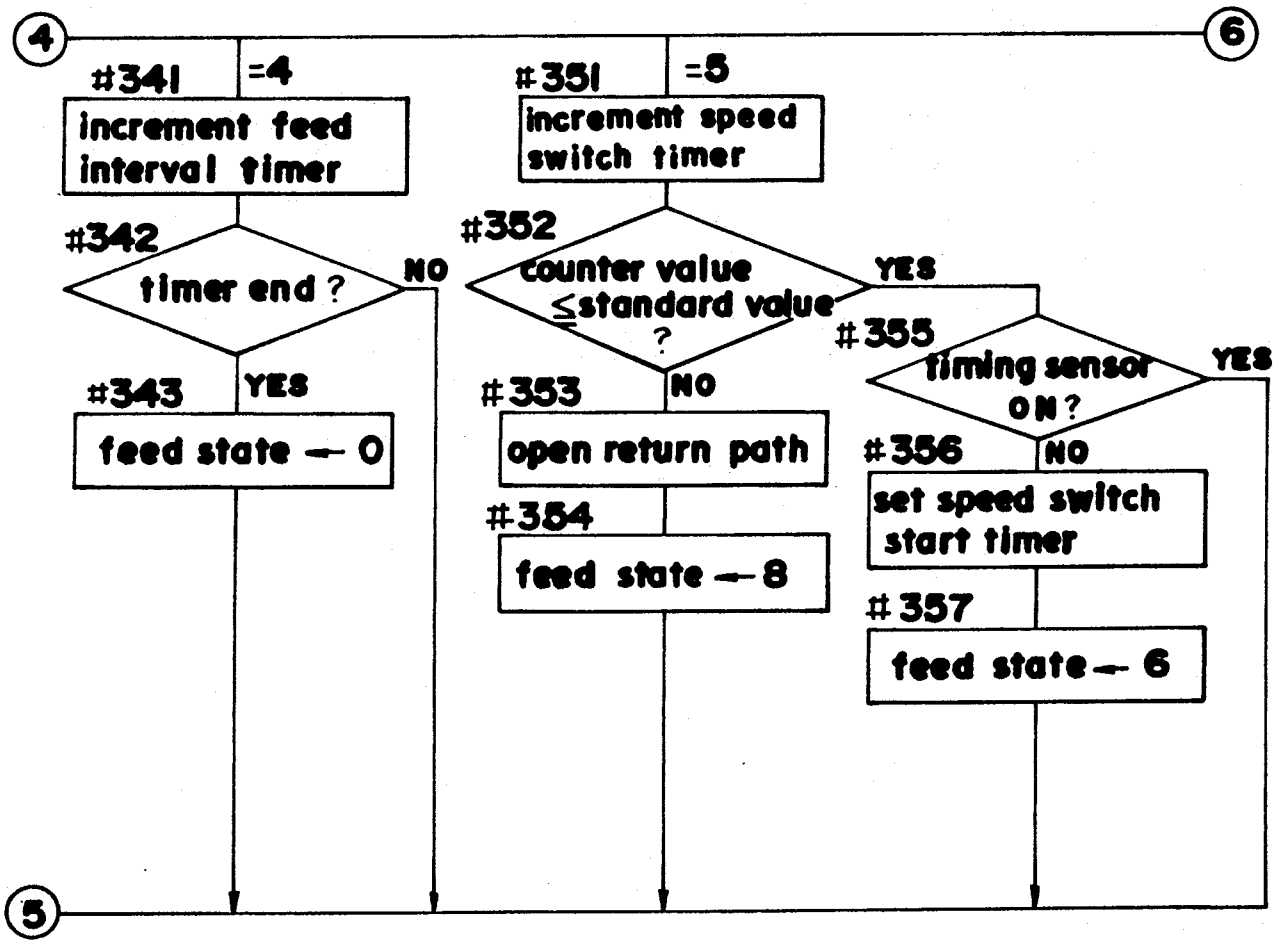
Figure 5E:
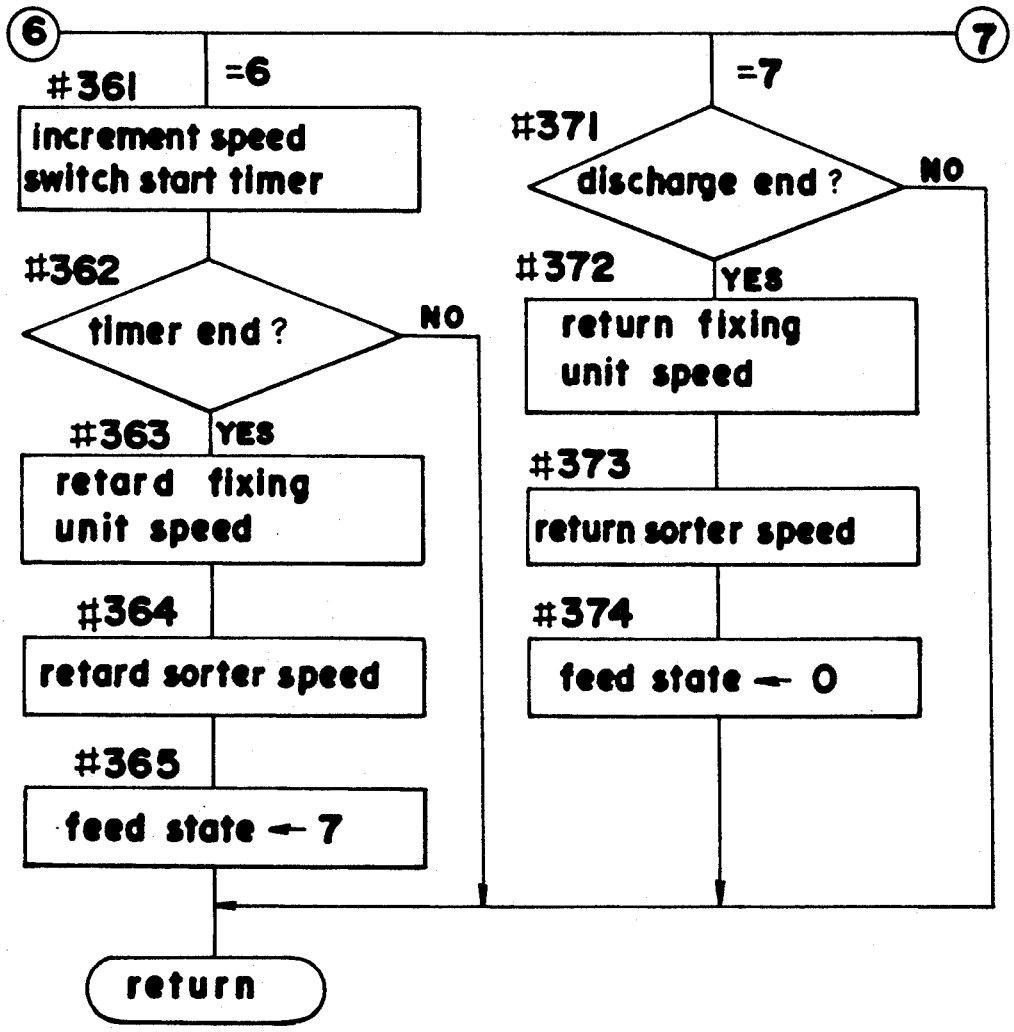
Figure 5F:
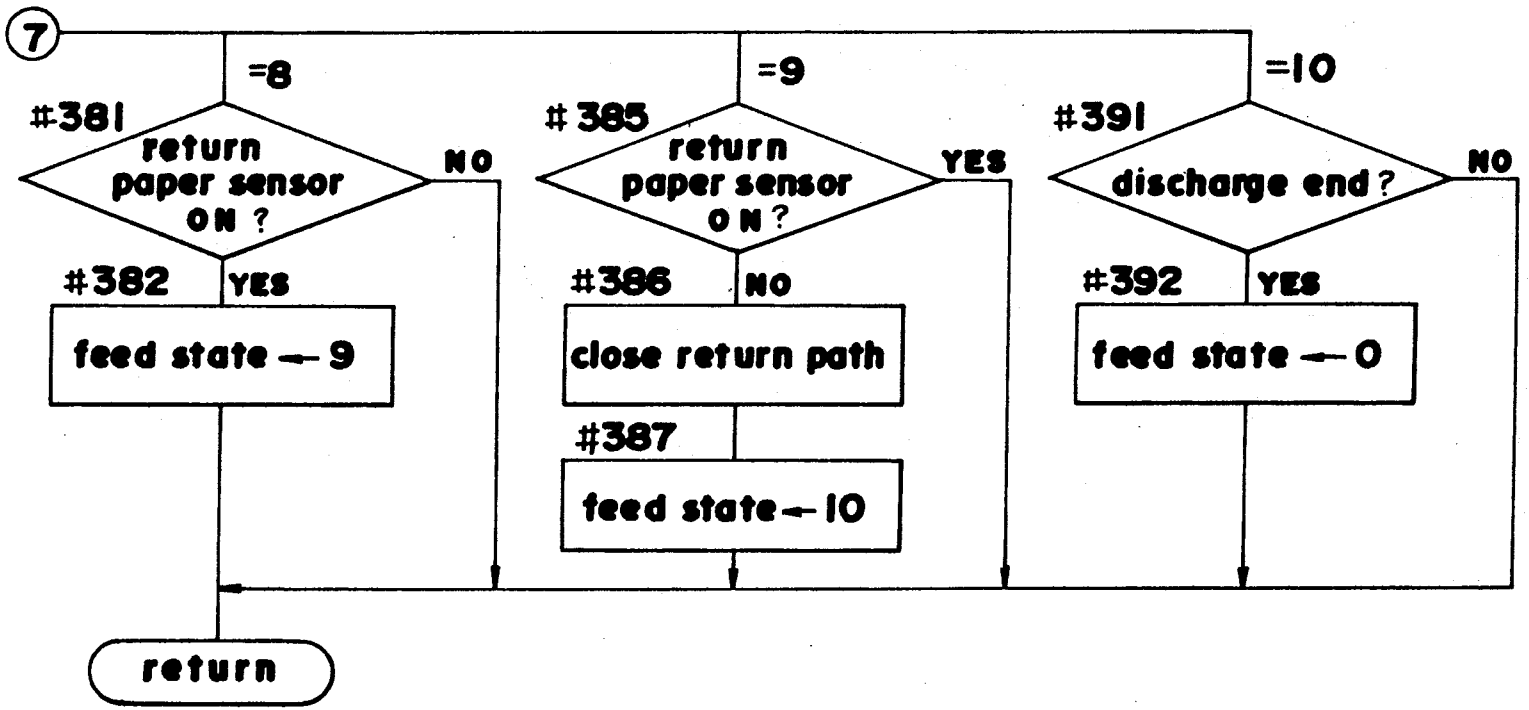

FIGS. 5*a* through 5*c* are flow charts of the sheet feeding process in step 6 of FIG. 4.

In this routine, a paper feed check is executed by displaying the counter value of the initial state counter (step 300), and the processing of each state is executed as described below.

The state is set at [0] during the standby state following the initialization state that is executed immediately after power is supplied as well as after the copying processes are completed.

In state [0], the sheet feed enable flag is checked (step 301).

The sheet feed enable flag is set in the image forming process after the main motor 24 and PC motor 25 are switched ON, and at completion of the motor rise timer clock to wait for stable rotation of each motor. The flag is reset upon completion of the sheet P is discharge.

When the sheet feed enable flag is set, the routine continues to check the manual sheet feed flag (step 302). The manual sheet feed flag is set and reset in the manual paper feed process in accordance with the state of each section as previously described.

When the manual paper feed flag is reset, either pickup roller 44 or 45 and the required feed roller 47 or 48 are switched On to feed paper from either cassette 42 or 43 specified by the paper selection keys 245 or 246 on operation panel OP. That is, the drive power of the main motor 24 is transmitted to each roller through a clutch (step 303).

When the manual feed flag is set, the manual feed roller 49 is switched ON (step 304).

Thus, after paper begins to feed from paper cassettes 42 and 43 or manual feed port 41, the state is updated and set at [1] (step 305).

In state [1], a check is made to determine whether or not the timing sensor 86 is in the ON state, i.e., the presence of paper P is checked.

When the leading edge of transported sheet P reaches the position of the timing sensor 86 and the timing sensor is switched to the ON state, the timing roller 46 and the rotating pickup roller 44 or 45 are switched OFF (steps 312 and 313). The previously switched ON sheet feed rollers 47 and 48 rotate continuously. The sheet P, accordingly, is curved at the entrance to the timing roller 46 thereby forming a so-called paper loop to correct the inclination of the sheet P relative to the transport direction.

Then, the paper loop timer is set to clock the time to produce a suitable paper loop (step 314), and the state is updated to [2] (step 315).

In state [2], first the paper loop timer is incremented, that is, the counter value is updated (step 321). Thereafter, the paper loop timer clock continues with each execution of a single routine of the main flow chart.

Next, a check is made to determine whether or not the paper loop timer count has reached a specified value, i.e., whether or not the clock has completed is checked (step 322).

When the clock has completed, the program continues and a check is made to determine whether or not the manual roller 49 is switched ON for manual paper feed (step 323).

If the manual roller 49 is in the OFF state, the rotation of the automatic feed rollers 47 and 48 are stopped (step 324). If the manual roller 49 is in the ON state, the rotation of the manual feed roller 49 is stopped (step 325).

When the aforesaid processing is completed the state is updated to [3].

In state [3], a check is made to determine whether or not the registration timing obtains for regulating the positional alignment of paper P and the toner image on transfer belt 11 (step 331).

If the registration timing obtains, the timing roller 46 is switched OFF and the transport of paper P toward the transfer position begins (step 332).

Next, a check is made to determine whether or not the OHP mode has been selected by the OHP key 233 (step 333). The OHP mode is the operating mode that either retards the rotational speeds of each roller 52 and 53 of the fixing unit 51 so that said rotational speeds are slower than normal, or prolongs the heating time for fixing the toner image on a single sheet P by transporting the single sheet P a plurality of times through the fixing unit 51 using the return device 60 so that said fixing time is longer than normal. When copy images are formed using the OHP mode, the toner image formed on sheet P is completely fused and the toner image surface is rendered flat to assure the light transmitting ability of the color portions of the copy image.

When the OHP mode is not selected, first a series of processes are executed to accomplish normal transport and discharge. That is, when a plurality of sheets P are continuously transported, a sheet feed interval timer is set to standardize the interval at which each sheet P is fed (step 334), and the state is updated to [4] (step 335). Then, in state [4], the sheet feed interval is updated (step 341), and by repeating state [4] step 341 is executed a number of times according to the time set in the sheet interval timer until the sheet feed timer clock is completed (step 342), whereupon the state is returned to the initialization state of [0] to move the sheet feed operation for next sheet P (step 343).

On the other hand, when the OHP mode is selected in the previously mentioned state [3], a check is made to determine whether or not copy image light transmitting ability is required for image formation (step 336). Light transmitting ability is determined to be unnecessary when a full color reproduction is specified, when it is determined that the original document image D is a monocolor black image by the image processing portion 100, and when black (BK) is selected as the monocolor copy developing color by means of the BK key 231. When the aforesaid light transmitting ability assurance is not required, the previously described series of processes are executed for normal transport and discharge.

Conversely, when copy image light transmitting properties are required, the following special processes are executed in the OHP mode.

That is, the speed switching timer is set (step 337), and the state is updated to [5]. The speed switching timer checks size of sheet P as a standard for determining whether or not the rotational speed of each roller 52 and 53 of fixing unit 51 can be reduced with preventing disruption of the toner image.

In state [5], the speed switching timer is updated (step 351), and thereafter a check is made to determine whether or not the counter value of the speed switching timer is less than a standard value related to the distance between the transfer position and the fixing position and the transport speed of sheet P (step 352).

When the counter value of the speed switching timer exceeds a standard value, the size of sheet P is large (for example A3 size) so as to overlay the secondary transfer position and the fixing unit 51. Accordingly, the rotational speeds of the rollers 52 and 53 of the fixing unit 51 cannot be reduced, so the switching hook 59 is operated so that the sheet P passes through the return path R2 of the return device 60 (step 353), and the state is updated to [8].

When the speed switching timer value is less than the standard value, a check is made to determine if the timing sensor 86 is in the ON state (step 355).

If the timing sensor is in the OFF state, the trailing edge of sheet P has already passed said timing sensor 86 so that the size of said sheet P is small, and the rotational speeds of each roller 52 and 53 are reducible. Next, the speed switching start timer is set to await the passage of the trailing edge of the sheet P at the secondary transfer position (step 356), and the state is updated to [6].

In state [6], the speed switching start timer is updated (step 361), and clock completion is checked (step 362).

When the speed switching start timer clock has completed, the rotational speed of the main motor 24 remains unchanged, and the clutches and the like are used to retard the rotational speeds of each roller 52 and 53 of fixing unit 51 (step 363).

To prevent damage to sheet P, the drive speeds of discharge roller 57 and sorter 2 are reduced below the normal speed so as to coincide with the transport speed of sheet P discharged from the fixing unit 51 (step 364).

The state is then updated to state [7] (step 365).

In state [7], the complete discharge of sheet P is verified by the detection state of the discharge sensor 88 (step 371), and the drive speeds of the fixing unit 51, sorter 2 and the like are returned to normal speeds (steps 372, 373), and the state is returned to state [0].

In state [8], a check is made to determine whether or not the return paper sensor 89 is in the ON state (step 381), the arrival of sheet P in the return path R2 is awaited and the state is updated to state [9] (step 365).

In state [9], a check is again made to determine whether or not the return paper sensor 89 is in the ON state (step 385), and following verification that the trailing edge of sheet P has passed the return paper sensor 89, the switching hook 59 is switched and return path R2 is closed (step 386). Then the state is updated.

In state [10], complete discharge of sheet P is confirmed (step 391), and the state is returned to state [0] (step 392).

Figure 6:
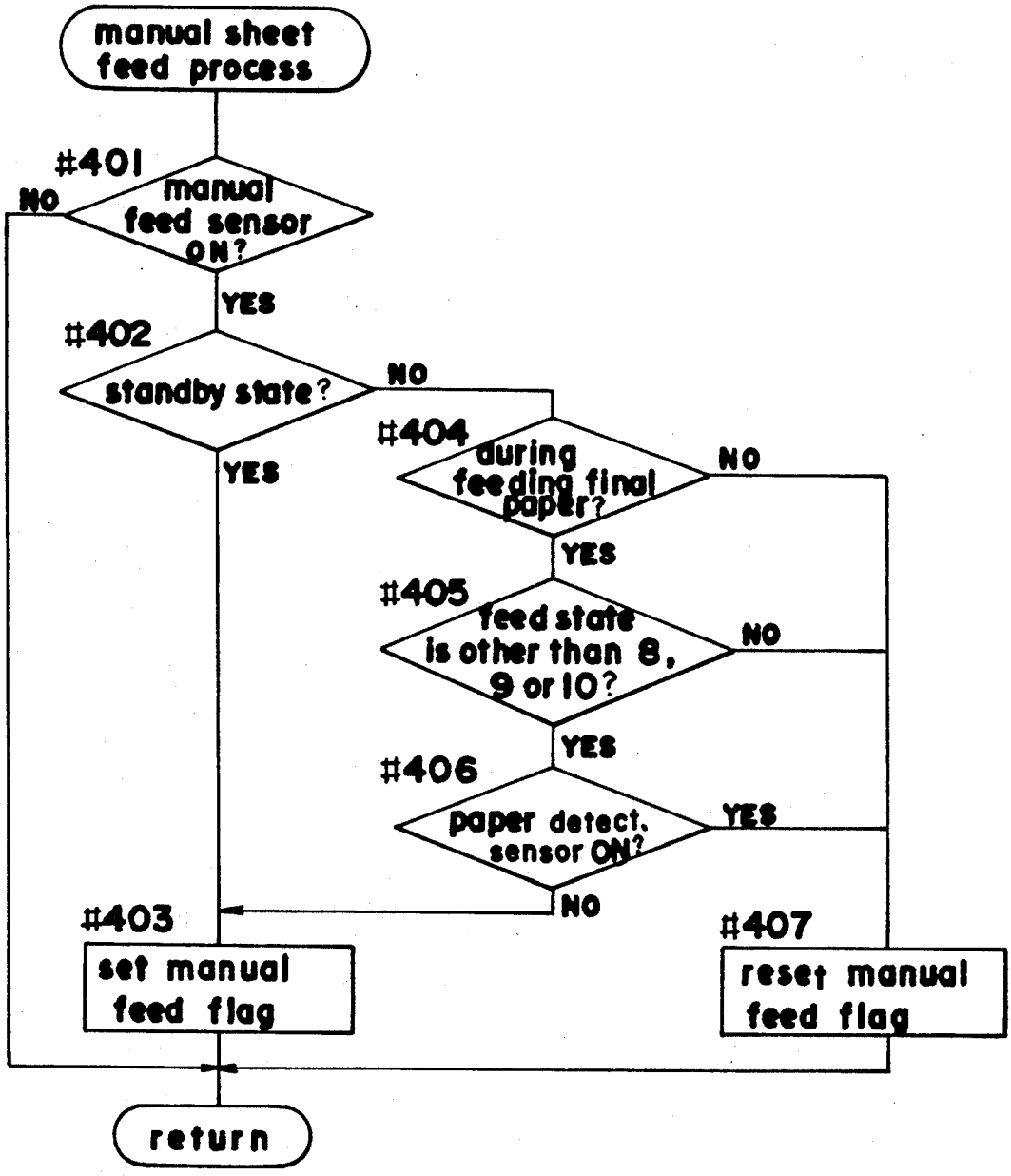
FIG. 6 is a flow chart showing the subroutine for executing step 7 of the main routine.
Figure 7A:
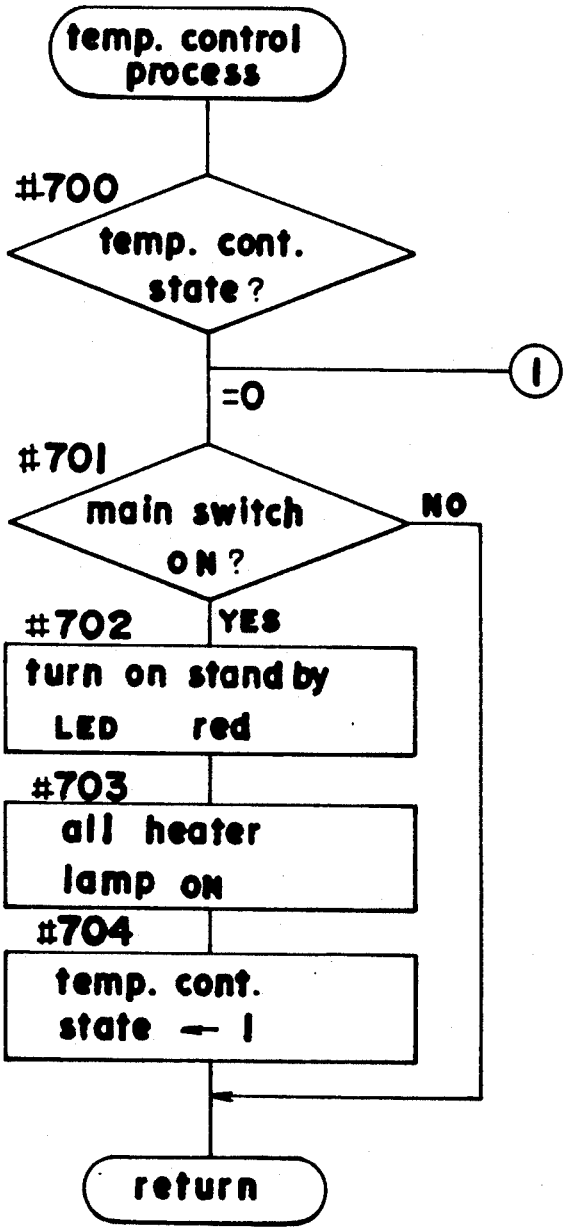
FIG. 7 is a flow chart showing the subroutine for executing step 8 of the main routine.
Figure 7B:
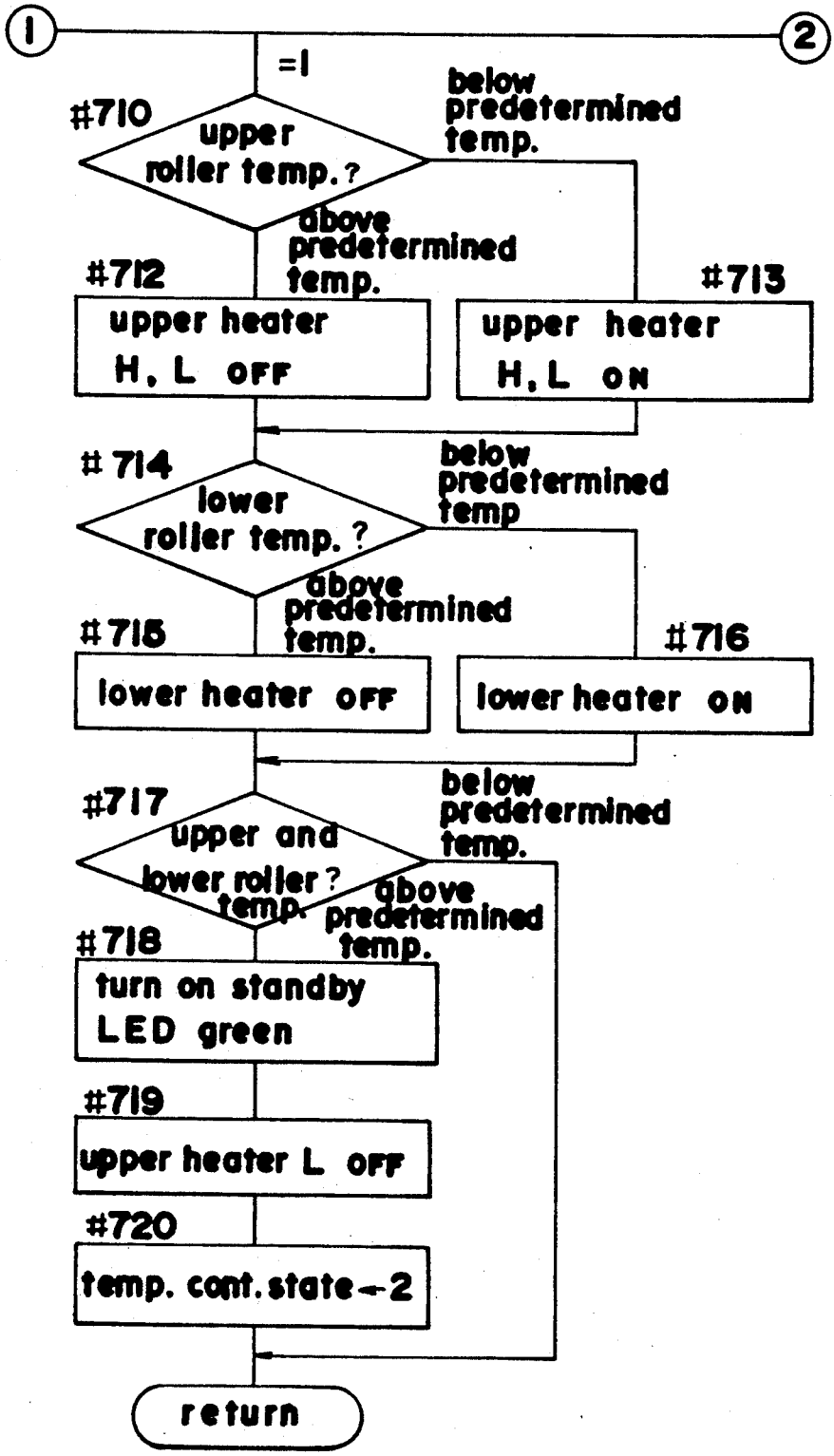
Figure 7C:
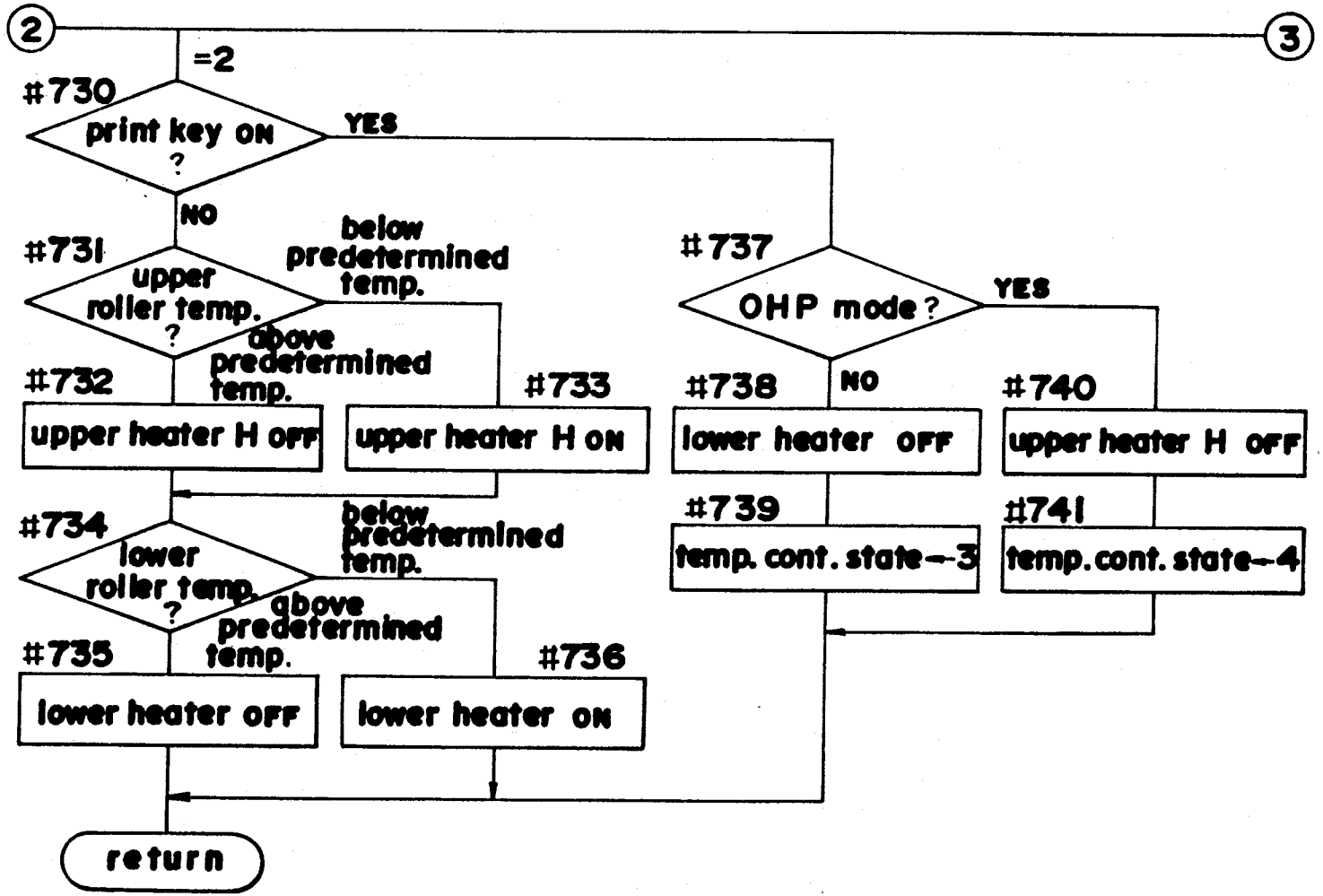
Figure 7D:
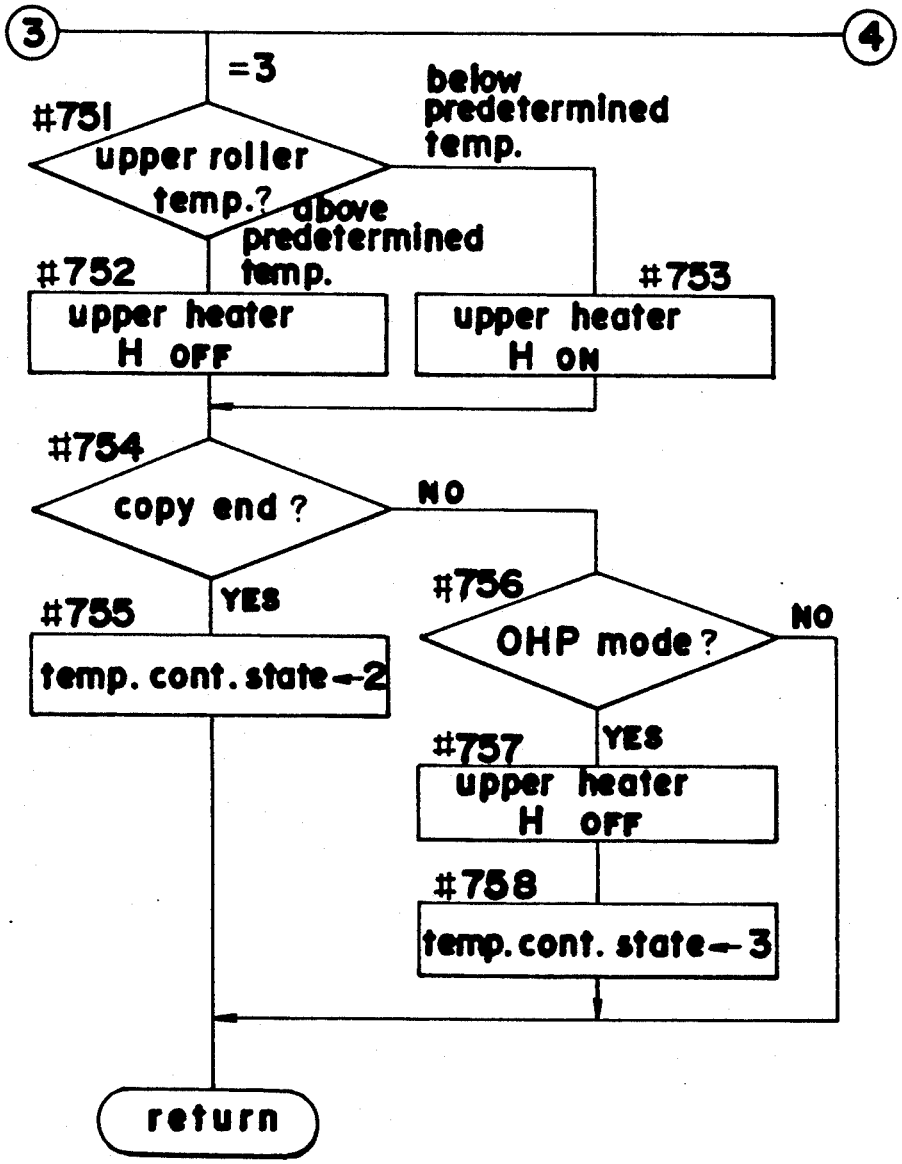
Figure 7E:
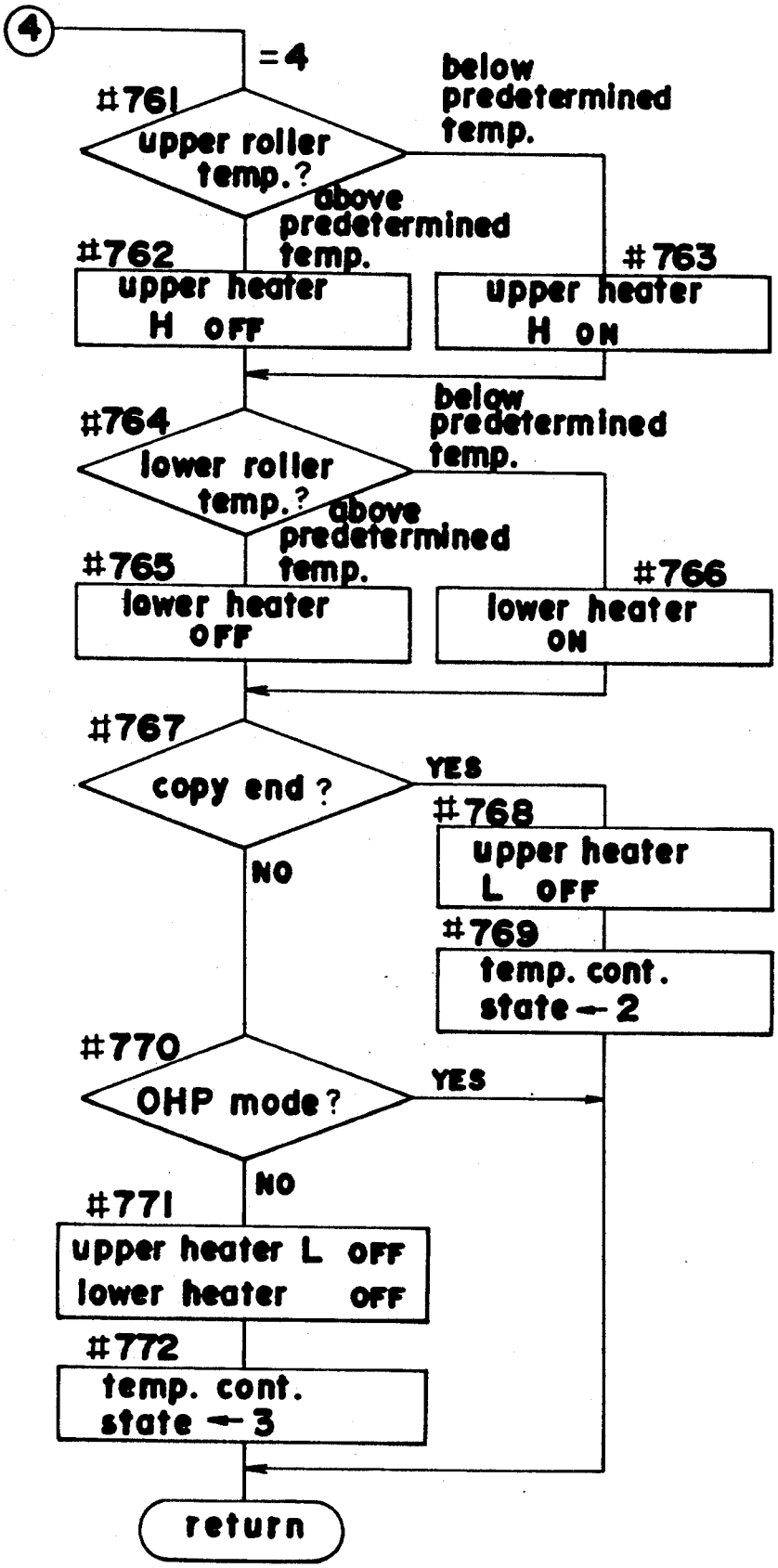

FIG. 6 is a flow chart showing the manual sheet feed process of FIG. 4.

First, a check is run to determine whether or not the manual feed sensor 87 is in the ON state (step 401). If a sheet P has been inserted into the manual feed port 41, a check is made to determine whether or not copying machine 1 is in the standby state (step 402).

If the copying machine is in the standby state, the previously mentioned manual feed flag is set (step 403).

If the copying machine is in a state other than standby, a check is made to determine whether or not the sheet P being transported at that moment, i.e., the sheet P that has not been discharged, corresponds to the final copy number specified by the ten-key pad 202 (step 404).

When the aforesaid transported sheet P is other than the final copy number, a check is made to determine the transport state of said sheet P, that is, whether or not the previously described transport state is other than state [8], [9] or [10] (step 405).

When the reply to the query in step 405 is NO, the manual feed flag is reset because transport of sheet by is being accomplished by the return device 60.

When the reply to the query in step 405 is YES, the routine continues and a check is made to determine the ON/OFF state of paper sensor 85 (step 406).

When the paper sensor 85 is in the ON state, the exposure scan is repeated for multilayer transfer; and the manual feed flag is reset to prevent the sheet P in the supply path R1 and the sheet P from the manual feed port 41 from stacking one on the other.

If the paper sensor 85 is in the OFF state, the manual feed flag is set in the previously mentioned step 403 and there is no concern of transport obstructions.

The present embodiment described above prevents damage to sheet P by reducing the transport speed in the path from fixing unit 51 to receiving tray 61 and in concert with a speed reduction to obtain copy image light transmittancy in fixing unit 51.

The present embodiment described above can form copy images having light transmitting properties on a transparency sheet P having a length at least twice the linear distance of the transport belt 50.

The present embodiment described above can prevent overlay transport of the sheets P even when a sheet P has been inserted in manual feed port 41 by detecting the presence of a sheet fed from cassettes 42 and 43 by means of a paper sensor 85 and the like, and controlling the operation of the manual feed roller 49.

The present embodiment described above standardizes the processing speeds in all electrophotographic processing except the fixing process independently of the copy mode, so that the entire electrophotographic process can be readily controlled and stable image quality can be achieved.

Further, although the copying machine 1 of the present embodiment has been described as forming images using Y, M and C toners to reproduce optional colors, the present invention can be adapted to single color copying machines if image formation with color toners is possible.

As can be readily understood from the preceding description, the present invention can decrease operator labor in the production of copy images having light transmitting properties such as OHP images and the like, and allows ready control of electrophotographic processing conditions to stabilize image quality.

In addition to the previously described effectiveness, copy images having light transmitting properties can be formed on large size recording sheets without enlarging the size of the copying machine, thereby broadening the range of applications of large-size recording papers.

Even when the OHP mode is selected, the image forming process for assuring light transmitting properties can be abbreviated when assuring such light transmitting properties is unnecessary for the copy image, thereby accelerating the copying process.

The heat regulating process for the top and bottom fixing rollers is described hereinafter.

FIG. 7 is a flow chart showing the heat regulating process of step 8. FIG. 8 is an illustration showing the conditions for supplying electrical power to the fixing unit 51. The circles in FIG. 8 indicate the execution of ON/OFF controls.

In the temperature regulating process in FIG. 7, the initial temperature regulating state indicated by the state counter (step 700), and the following processes are executed in accordance with each state.

State is [0] prior to the main switch being switched ON, and when the main switch is switched OFF during execution of each state process.

In state [0], first a check is made to determine if the main switch is ON (step 701). If the main switch is ON, the standby display LED 200*a* on the operation panel OP is lighted red (step 702) to alert the operator that print key 200 has not been operated.

Next, in order to shorten as much as possible the first copy time from the moment the main switch is switched ON until copying is enabled, all heating lamps 54, 55 and 56 are switched ON and heating is started for the top roller 52 and the bottom roller 53 (step 703), as shown in FIG. 6. Then, the state is updated to [1].

In the following description, the heating lamps 54 and 55 for top roller 52 are referred to as top H-heater 54 and top L-heater 55; heating lamp 56 for bottom roller 53 is referred to as bottom heater 56.

In state [1], first the temperature of the top 52 is checked based on the output of the temperature sensor 91 (step 710).

When the temperature of top roller 52 exceeds a reference temperature of, for example, about 160° C., top H-heater 54 and top L-heater 55 are switched OFF (step 712). If the temperature of the top roller 52 is less than a reference temperature, the top H-heater 54 and top L-heater 55 are switched ON (step 713).

The temperature of the bottom heater 53 is checked based on the output of the temperature sensor 92 (step 714).

When the temperature of the bottom roller 53 exceeds a reference temperature, the bottom heater 56 is switched OFF (step 715). If the temperature of the bottom roller 53 is less than a reference temperature, the bottom heater 56 is switched ON (step 716).

Next, a check is made to determine whether or not the temperatures of the top roller 52 and the bottom roller 53 exceed the reference temperatures, i.e., whether or not the warm up has been completed (step 717).

If the warm up has been completed, the standby display LED is lighted green to alert the operator that the copy operation may be started (step 718).

Thereafter, the temperature of top roller 52 is maintained by the top H-heater 54 alone to conserve power, and the top L-heater 55 is switched OFF (step 719). The state is then updated to [2]. Thus, the fixing unit 51 is in the standby state.

In state [2], an initial check is made to find whether or not the print key 200 is switched ON (step 730).

Until the print key 200 is depressed, the top H-heater 54 and the bottom heater 56 are controllably switched ON/OFF (steps 731 through 736) so as to maintain the temperature of the top roller 52 and the bottom roller 53 at the reference temperatures as the processing of the standby state.

On the other hand, when the print key 200 is depressed, a check is run to determine whether or not the OHP mode has been selected by the OHP key 233 on the operation panel OP (step 737).

When the OHP mode has not been selected, i.e., when the normal copy mode is selected, the bottom heater 56 is switched OFF (step 738), and the state is updated to [3]. Accordingly, in the normal copy mode, a maximum 700 W of power is supplied only to the top H-heater 54 (refer to FIG. 8) to regulate the temperature of the top roller 52.

Further, when the OHP mode has been selected, the top H-heater 54 is switched OFF (step 740), and the state is updated to [4].

In state [3], first the top H-heater 54 alone is controllably switched ON/OFF to maintain the temperature of the top roller 52 at the reference temperature (steps 751 through 753) as processing for the normal copy mode.

Next, a check is made to determine whether or not discharge of all sheets P has been completed and the copying operation is finished (step 754).

When the copying operation is finished, the state returns to [2] so as to return to the standby state processing.

Prior to the completion of the copying operation, a check is made to determine whether or not the OHP mode has been selected (step 756). If the OHP mode has been selected, the top H-heater 54 is switched OFF (step 757), and the state is updated to [4].

In state [4], the temperatures of the top roller 52 and the bottom roller 53 are maintained at the reference temperatures by controlling the ON/OFF switching of the top L-heater 55 and the bottom heater 56 (steps 761 through 766), as shown in FIG. 8, as the processing for the OHP mode. That is, in the OHP mode the top L-heater 55 and the bottom heater 56 are supplied a total power of 700W (refer to FIG. 8), so as to regulate the temperature of the top roller 52 and the bottom roller 53.

Thereafter, a check is made to determine whether or not the copy operation is completed (step 767). If the copy operation is completed, the top L-heater 55 is switched OFF (step 768), and the state is returned to [2].

Prior to the completion of the copying operation the copy mode is checked (step 770). When the OHP mode is canceled, the top L-heater 55 and the bottom heater 56 are switched OFF (step 771), and the state is changed to [3].

In copying machine 1, a maximum combined power of 1050W is supplied to the top H-heater 54 and the bottom heater 56 during the standby period, but the power that can be supplied to the fixing unit 51 during the copying operation is comparatively less due to the overall power consumption of the entire copying machine because power must be supplied to the exposure lamp 33, the charger 4, the motors 24 and 25 and the like. Accordingly, in order to efficiently use the limited available power, the 700W of power that can be supplied to the fixing unit 51 must be concentratedly supplied to regulate the temperature of the top roller 52 in the roller set 52 and 53 in the normal copy mode, and must be distributed to regulate the temperatures of the top roller 52 and the bottom roller 53 in the OHP mode.

The present embodiment provides the top roller 52 of the fixing unit 51 with two separate heaters, i.e., top H-heater 54 and top L-heater 55, each having different power ratings, and continuously regulates the temperatures of both top roller 52 and bottom roller 53 in the OHP mode using the top L-heater 55 for temperature regulation, and uses the top H-heater 54 to regulate the temperature of the top roller 52 only in the normal copy mode, thereby allowing the power to be uniformly supplied for temperature regulation in the OHP mode and the normal copy mode and simplifying the power distribution to the entire copying machine 1.

Although the present embodiment has been described in terms of copying machine 1 wherein the power rating for heating lamps 54, 55 and 56 were selectively 700W, 350W and 350W, respectively, the power rating values may be modified so as to be suitable in accordance with variations in the power that must be supplied to the exposure lamp 33, charger 4, motors 24 and 25, and other devices. For example, when the power that can be supplied to the heater lamps 54, 55 and 56 during the copying operation, i.e., the power remaining after power consumption by all other components of the copying machine 1, is 800W, the power rating of the heating lamps 54, 55 and 56 may be 400W. In the normal copy mode, the heating lamps 54 and 55 may be switched ON, and in the OHP mode the heating lamp 54 or 55 and lamp 56 may be switched ON. The value of the power supplied during the normal copy mode and the value of the power supplied during the OHP mode need not necessarily agree.

The present embodiment, power is distributed uniformly to the top roller 52 and the bottom roller 53 in the OHP mode, but the ratio of the power distribution may be suitably set to correspond to the set fixing conditions and the calorific capacity of the top roller 52 and the bottom roller 53.

In the present invention, the paper feed process, manual sheet feed process, and temperature regulating process need not necessarily all be executed, inasmuch as only the paper feed process and the manual sheet feed process, or the temperature regulating process alone may be executed.

Although the present invention has been fully described by way of examples with reference to the accompanying drawings, it is to be noted that various changes and modifications will be apparent to those skilled in the art. Therefore, unless otherwise such changes and modifications depart from the scope of the invention, they should be construed as being included therein.

What is claimed is:

1. An image forming apparatus capable of forming images on transparency sheets comprising:

developing means for forming a color toner image;

fixing means for fixing the toner image developed by said developing means on a recording member;

returning means for returning the recording member discharged from said fixing means to said fixing means again;

control means for controlling to send the recording member to said returning means so that the recording member passes through said fixing means a plurality of times in a OHP mode for forming images on transparency sheets.

2. The image forming apparatus as claimed in claim 1 further comprising paper size detecting means for detecting the size of the recording member, wherein in the OHP mode said controlling means controls to send the recording member to said returning means when the size of the recording member detected by said paper size detecting means is larger than a predetermined value, and controls to operate said fixing means more slowly than a case of forming images on non-transparency sheets when the size of the recording member detected by said paper size detecting means is smaller than the predetermined value.

3. The electrophotographic image forming apparatus as claimed in claim 2, further comprising reading means for reading the original image and determination means for determining colors of the original image read by said reading means, wherein said control means controls to operate said returning means and said fixing means in accordance with the operation process in the OHP mode when said determination means determines that the original image includes colors other than black.

4. An electrophotographic image forming apparatus capable of forming images on transparency sheets comprising:

developing means for forming color toner image corresponding to an original image;

fixing means for fixing the toner image developed by said developing means on a recording member;

selecting means for selecting a first mode for forming images on transparency members or a second mode for forming images on non-transparency members;

paper size detecting means for detecting the size of the recording member;

returning means for returning the recording member discharged from said fixing means to said fixing means again; and control means for controlling to send the recording member to said returning means so that the recording member passes through said fixing means a plurality of times when the first mode is selected by said selecting means and the size of the recording member detected by said paper size detecting means is larger than a predetermined value, and controlling to operate said fixing means more slowly than a case of forming images on a non-transparency sheet when the size of the recording member detected by said paper size detecting means is smaller than the predetermined value.

5. The electrophotographic image forming apparatus as claimed in claim 4, further comprising reading means for reading the original image and determination means for determining colors of the original image read by said reading means, wherein said control means controls to operate said returning means and said fixing means to operate in accordance with the operation process in the OHP mode when said determination means determines that the original image includes colors other than black.

6. An electrophotographic image forming apparatus capable of forming images on transparency sheets comprising:

developing means for forming color toner image corresponding to an original image;

fixing means for fixing the toner image developed by said developing means on a recording member;

selecting means for selecting a first mode for forming images on transparency members or a second mode for forming images on non transparency members;

paper size detecting means for detecting the size of the recording member;

returning means for returning the recording member discharged from said fixing means to said fixing means again;

reading means for reading the original image;

determining means for determining color of the original image read by said reading means;

control means for controlling, when the first mode is selected by said selecting means and said determination means determines that the original image includes colors other than black, to send the transparency sheet to said returning means so as to pass through said fixing means a plurality of times when the size of the transparency sheet detected by said paper size detecting means is larger than a predetermined value, and for controlling to operate said fixing means more slowly than a case of forming image son non-transparency sheets when the size of the transparency sheet detected by said paper size detecting means is smaller than a predetermined value.

7. An electrophotographic image forming apparatus comprising:

fixing means including a first roller which faces a surface side of a recording member and a second roller which faces a rear side of the recording member for fixing a toner image formed on the surface side;

supplying means for supplying heating power to said first and second roller;

selecting means for selecting a first mode for forming images on transparency members or a second mode for forming images on non-transparency members; and control means for controlling to supply heating power to said first and second rollers by said supplying means in the first mode, and to supply heating power only to said first roller by said supplying means in the second mode.

8. An electrophotographic image forming apparatus capable of forming images on transparency members comprising:

fixing means including an first roller which faces a surface side of a recording member and a second roller which faces a rear side of the recording member for fixing a toner image formed on the surface side;

first heating means for heating said first roller;

second heating means for heating said second roller selecting means for selecting a first mode for forming images on transparency members or a second mode for forming images on non-transparency members; and control means for controlling to operate both of said first and second heating means when the first mode is selected by said selecting means, and to operate said first heating means only when the second mode is selected by said selecting means.

9. The electrophotographic image forming apparatus as claimed in claim 8, wherein said first heating means includes a first and a second heating members and said second heating means includes a third heating member.

10. The electrophotographic image forming apparatus as claimed in claim 8, wherein said control means controls to operate said second and third heating members in the first mode, and to operate said first heating member in the second mode.

11. The electrophotographic image forming apparatus as claimed in claim 8, wherein the total heating power of said second and third heating member is equal to the heating power of said first heating member.

12. An electrophotographic image forming apparatus capable of forming images on transparency sheets comprising:

developing means for forming a color toner image corresponding to an original image;

fixing means including a first roller which faces a surface side of a recording member and a second roller which faces a rear side of the recording member for fixing the toner image formed on the surface side;

selecting means for selecting a first mode for forming images on transparency members or a second mode for forming images on non-transparency members;

first heating means for heating the first roller;

second heating means for heating the second roller;

returning means for returning the recording member discharged from said fixing means to said fixing means again; and control means for, when the first mode is selected by said selecting means, controlling to send the recording member to said returning means so that the recording member passes through said fixing means a plurality of times and to operate said first and second heating means in each said plurality of times, and when the second mode is selected, controlling to send the recording member to said fixing means once and to operate said first heating means only.

* * * * *